US009575456B2

(12) United States Patent
Itoh

(10) Patent No.: US 9,575,456 B2
(45) Date of Patent: Feb. 21, 2017

(54) IMAGE FORMING APPARATUS HAVING FIXING PORTION INCLUDING INDEPENDENTLY CONTROLLABLE FIRST AND SECOND HEAT GENERATING ELEMENTS

(71) Applicant: CANON KABUSHIKI KAISHA, Tokyo (JP)

(72) Inventor: Masatoshi Itoh, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/503,692

(22) Filed: Oct. 1, 2014

(65) Prior Publication Data

US 2015/0093134 A1 Apr. 2, 2015

(30) Foreign Application Priority Data

Oct. 2, 2013 (JP) ..... 2013-207243

(51) Int. Cl.
*G03G 15/20* (2006.01)
*G03G 15/00* (2006.01)

(52) U.S. Cl.
CPC ..... *G03G 15/80* (2013.01); *G03G 15/2039* (2013.01); *G03G 2215/2035* (2013.01)

(58) Field of Classification Search
CPC . G03G 15/80; G03G 15/2078; G03G 15/2064
See application file for complete search history.

(56) References Cited

U.S. PATENT DOCUMENTS

| | | | | |
|---|---|---|---|---|
| 7,511,727 | B2 | 3/2009 | Nishida | |
| 2007/0116485 | A1 | 5/2007 | Nishida | |
| 2010/0310267 | A1* | 12/2010 | Shimura et al. | 399/69 |
| 2010/0316404 | A1* | 12/2010 | Fukuzawa et al. | 399/69 |
| 2011/0217062 | A1* | 9/2011 | Chosokabe et al. | 399/69 |
| 2011/0280596 | A1* | 11/2011 | Shimura | 399/33 |
| 2011/0305469 | A1* | 12/2011 | Fujiwara et al. | 399/33 |
| 2013/0071134 | A1* | 3/2013 | Hikari et al. | 399/88 |
| 2013/0322908 | A1* | 12/2013 | Ogura | 399/69 |
| 2014/0093268 | A1* | 4/2014 | Iwasaki et al. | 399/70 |
| 2014/0169811 | A1* | 6/2014 | Shimura | 399/33 |

FOREIGN PATENT DOCUMENTS

| | | | |
|---|---|---|---|
| JP | 10-91017 | A | 4/1998 |
| JP | 2005-195640 | A | 7/2005 |
| JP | 2006-304534 | A | 11/2006 |
| JP | 2013-70526 | A | 4/2013 |

* cited by examiner

*Primary Examiner* — Clayton E LaBalle
*Assistant Examiner* — Ruifeng Pu
(74) *Attorney, Agent, or Firm* — Fitzpatrick, Cella, Harper & Scinto

(57) ABSTRACT

An image forming apparatus includes: a power source portion; a fixing portion; and a controller. The controller sets a waveform of a current to be passed through each of first and second heat-generating-elements of the fixing portion in one control period so that, in a synchronous half wave in one control period, the current passes through one heat-generating-element from a halfway point of the half wave and the current passes through or does not pass through the other heat-generating-element throughout a half wave period. The controller sets a current supply starting timing of the current passing through the one heat-generating-element, at timing when a current passing toward the power source portion stops.

13 Claims, 16 Drawing Sheets

(a)

(b)

| | 1ST P(i) | 1ST N(ii) | 2ND P(iii) | 2ND N(iv) | 3RD P(v) | 3RD N(vi) | 4TH P(vii) | 4TH N(viii) |
|---|---|---|---|---|---|---|---|---|
| 1ST HGE | 100 | 40 | 40 | 100 | 100 | 40 | 40 | 100 |
| 2ND HGE | 40 | 100 | 100 | 40 | 40 | 100 | 100 | 40 |

(a)

| | 1ST P | 1ST N | 2ND P | 2ND N | 3RD P | 3RD N | 4TH P | 4TH N |
|---|---|---|---|---|---|---|---|---|
| 1ST HGE | 100 | 70 | 70 | 100 | 100 | 70 | 70 | 100 |
| 2ND HGE | 70 | 100 | 100 | 70 | 70 | 100 | 100 | 70 |

(b)

| | 1ST P | 1ST N | 2ND P | 2ND N | 3RD P | 3RD N | 4TH P | 4TH N |
|---|---|---|---|---|---|---|---|---|
| 1ST HGE | 100 | 100 | 40 | 100 | 100 | 40 | 100 | 100 |
| 2ND HGE | 40 | 100 | 100 | 100 | 100 | 100 | 100 | 40 |

(c)

| | 1ST P | 1ST N | 2ND P | 2ND N | 3RD P | 3RD N | 4TH P | 4TH N |
|---|---|---|---|---|---|---|---|---|
| 1ST HGE | AE or NE (Piso(0)) | PHS 1 (Piso(1)) | PHS 2 (Piso(2)) | AE or NE (Piso(0)) | AE or NE (Piso(0)) | PHS 2 (Piso(2)) | PHS 1 (Piso(1)) | AE or NE (Piso(0)) |
| 2ND HGE | PHS 1 (Piso(1)) | AE or NE (Piso(0)) | AE or NE (Piso(0)) | PHS 2 (Piso(2)) | PHS 2 (Piso(2)) | AE or NE (Piso(0)) | AE or NE (Piso(0)) | PHS 1 (Piso(1)) |

(d)

FIG.6

IMAGE FORMING APPARATUS HAVING FIXING PORTION INCLUDING INDEPENDENTLY CONTROLLABLE FIRST AND SECOND HEAT GENERATING ELEMENTS

FIELD OF THE INVENTION AND RELATED ART

The present invention relates to an image forming apparatus using an electrophotographic process.

In recent years, also in the image forming apparatus using the electrophotographic process, there is a tendency that electric power consumed by a fixing device is increased with speed-up and diversification of options, and thus the capacity of a low-voltage power source portion is increased. In such a situation, in order to lower the maximum current consumption by increasing the power factor of the low-voltage power source portion, e.g., as described in Japanese Laid-Open Patent Application (JP-A) 2006-304534, there is an increasing use of a switching power source in which a power factor improving circuit such as a step-up active filler, is mounted.

However, the power factor improving circuit has a complicated circuit structure, and thus leads to an increase in the cost of the low-voltage power source portion, and due to an increase in the circuit, a large space is needed for providing the low-voltage power source portion. For this reason, it has been desired that the power factor is improved.

SUMMARY OF THE INVENTION

The present invention has been accomplished in the above-described situation. A principal object of the present invention is to provide an image forming apparatus capable of improving the power factor while reducing the cost of the apparatus.

According to an aspect of the present invention, there is provided an image forming apparatus comprising: a power source portion for converting an AC voltage of a commercial power source into a DC voltage; and a fixing portion for heating and fixing an image, formed on a recording material, on the recording material. The fixing portion includes a first heat generating element which generates heat by electric power supplied from the commercial power source and a second heat generating element which is controlled independently of the first heat generating element and which generates the heat by the electric power supplied from the commercial power source. The apparatus also includes a controller for controlling the electric power supplied to the first and second heat generating elements. When a plurality of periods of an AC waveform of the commercial power source constitute one control period, the controller sets a waveform of a current to be passed through each of the first and second heat generating elements in the one control period so that total electric power supplied to the first and second heat generating elements in the one control period is dependent on a temperature of the fixing portion. The controller sets the waveform of the current to be passed through each of the first and second heat generating elements so that, in an equiphase half wave in at least a part of the one control period, the current passes through one of the first and second heat generating elements from a halfway point of the half wave and the current passes through or does not pass through the other heat generating element throughout a period of the half wave. The controller sets a current supply starting timing of the current passing through the one of the first and second heat generating elements from the halfway point of the half wave, at timing when a current passing toward the power source portion stops.

According to another aspect of the present invention, there is provided an image forming apparatus comprising: a fixing portion for heating and fixing an image, formed on a recording material, on the recording material. The fixing portion includes a first heat generating element which generates heat by electric power supplied from the commercial power source and a second heat generating element which is controlled independently of the first heat generating element and which generates the heat by the electric power supplied from the commercial power source. The apparatus also includes a controller for controlling the electric power supplied to the first and second heat generating elements. The controller switches a rule of a waveform of an AC current to be passed through each of the first and second heat generating elements depending on a duty ratio of total electric power supplied to the first and second heat generating elements.

According to a further aspect of the present invention, there is provided an image forming apparatus comprising: a power source portion for converting an AC voltage of a commercial power source into a DC voltage; and a fixing portion for heating and fixing an image, formed on a recording material, on the recording material. The fixing portion includes a first heat generating element which generates heat by electric power supplied from the commercial power source and a second heat generating element which is controlled independently of the first heat generating element and which generates the heat by the electric power supplied from the commercial power source.

The apparatus also includes: a current detecting portion for detecting a resultant current passing through the power source portion and the first and second heat generating elements; and a controller for controlling the electric power supplied to the first and second heat generating elements. The controller sets the length of the one control period depending on a detected current of the current detecting portion.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

In FIG. 6, (*a*) to (*d*) are tables showing supplied electric power patterns to heaters in Embodiment 1 and Comparison Example.

DESCRIPTION OF THE EMBODIMENTS

With reference to the drawings, embodiments for carrying out the present invention will be specifically described below. However, the dimensions, the materials, the shapes and the relative arrangement of constituent elements described in the following embodiments should be appropriately changed depending on structure and various conditions of devices (apparatuses) to which the present invention is to be applied. That is, the scope of the present invention is not intended to be limited to the following embodiments.

Embodiment 1

General Structure of Image Forming Apparatus

Figure 1A:
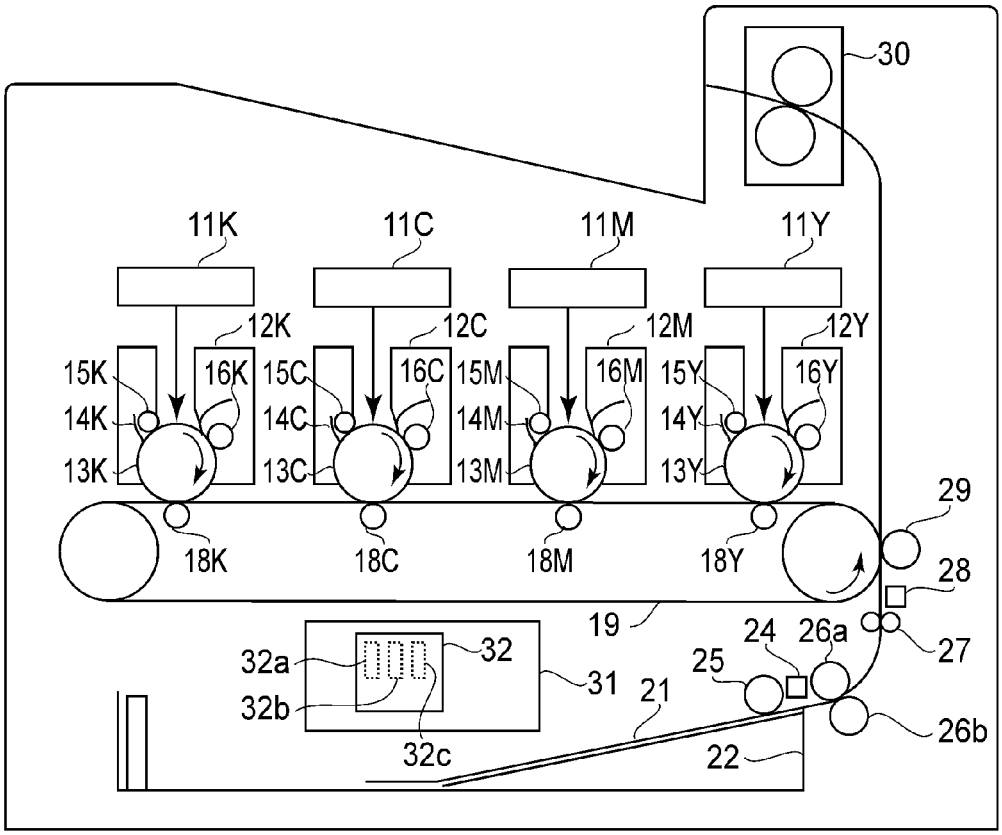
FIGS. 1A to 1D are schematic views showing structures of an image forming apparatus, a fixing device, a heater and the heater, respectively.

FIG. 1A is a schematic illustration of a color image forming apparatus of a tandem type using an electrophotographic process in Embodiment 1. The image forming apparatus in this embodiment is constituted so that a full-color image can be outputted by superposing toner images of four colors of yellow (Y), magenta (M), cyan (C) and black (K). In the following description, in the case where there is a need to designate a predetermined color, members or portions are represented by adding Y, M, C, K to reference numerals or symbols, and in the case where there is no need to designate the predetermined color, the members are presented by the reference numerals without adding Y, M, C, K. In the image forming apparatus in this embodiment, in order to form the respective color toner images, laser scanners 11 and cartridges 12 are provided. The cartridges 12 one constituted by photosensitive drums 13 as image bearing members rotatable in arrow (clockwise direction) directions in FIG. 1A and developing devices including developing rollers 16. The cartridges 12 include photosensitive drum cleaners 14 provided in contact with the photosensitive drums 13, charging rollers 15 and the developing rollers 16. Further, the respective photosensitive drums are provided in contact with an intermediary transfer belt 19, and primary transfer rollers 18 are provided opposed to the photosensitive drums 13 via the intermediary transfer belt 19.

In the neighborhood of a cassette 22 for accommodating a sheet 21 as a recording material (medium), a sheet presence/absence detecting sensor 24 for detecting the presence or absence of the sheet 21 in the cassette 22 is provided. Further, in a feeding path of the sheet 21, a sheet feeding roller 25, separation rollers 26*a* and 26*b* and a register roller pair 27 are provided, and in the neighborhood of the register roller pair 27, downstream thereof with respect to a sheet feeding direction, a register sensor 28 is provided. Further downstream in the feeding path with respect to the sheet feeding direction, a secondary transfer roller 29 is provided in contact with the intermediary transfer belt 19, and a fixing device 30 is provided downstream of the secondary transfer roller 29.

A controller 31 as a control portion of the image forming apparatus is constituted by a CPU (central processing unit) 32 including ROM 32*a*, RAM 32*b*, a timer 31 and the like, and by various input/output control circuits (not shown) and the like.

Next, the electrophotographic process will be briefly described. Surfaces of the photosensitive drums 13 are electrically charged uniformly by the charging rollers 15. Then, the surfaces of the photosensitive drums 13 are irradiated, by the laser scanners 11, with laser light modulated depending on image data. Electric charges at a portion where the photosensitive drum is irradiated with the laser light are removed, so that electrostatic latent images are formed on the surfaces of the photosensitive drums 13. As a result, the respective color toner images are formed on the surfaces of the photosensitive drums 13.

The toner images formed on the photosensitive drums 13 are attracted toward the intermediary transfer belt 19 at nips between the intermediary transfer belt 19 and the respective photosensitive drums 13 by the primary transfer rollers 18 to which a primary transfer voltage is applied. Then, the respective color toner images are successively transferred onto the intermediary transfer belt 19, so that a full-color image is finally formed on the intermediary transfer belt 19.

On the other hand, the sheet 21 in the cassette 22 is fed by the sheet feeding roller 25, and then by the separation rollers 26*a* and 26*b*, the sheet 21 is passed through the register roller pair 27 one by one and then is conveyed to the secondary transfer roller 29. At a nip between the intermediary transfer belt 19 and the secondary transfer roller 29 disposed downstream of the register roller pair 28, the toner image is transferred from the intermediary transfer belt 19 onto the sheet 21. Finally, the toner image on the sheet 21 is heat-fixed by the fixing device 30 as a heating portion, and the sheet 21 is discharged to an outside of the image forming apparatus.

[Fixing Device]

Figure 1B:
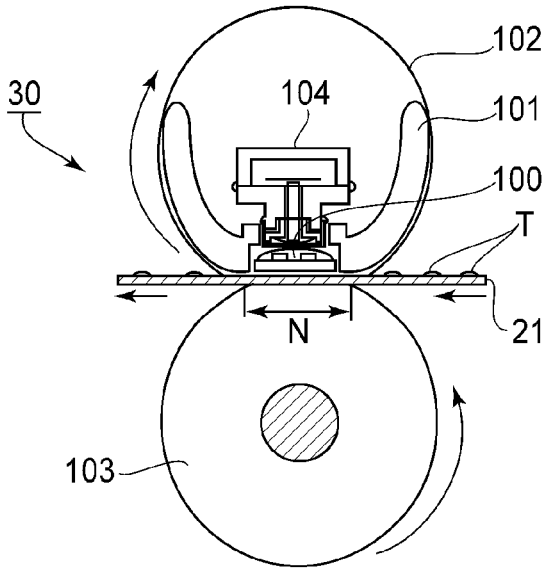

FIG. 1B is a schematic sectional view of the fixing device 30 in this embodiment. The fixing device 30 is a heating device (apparatus) of a pressing-roller drive type and of a film-heating type using, e.g., an endless film (cylindrical film), and generally has the following structure. The fixing device 30 includes a heater 100 as a heating means, and a heater holder 101 on which the heater 100 is fixed and held. The fixing device 30 further includes a cylindrical thin heat-resistant film (fixing film) 102 externally fitted loosely around the heater holder 101 on which the heater 100 is mounted. The fixing device 30 includes a pressing roller 103 press-contacted to the fixing film 102 toward the heater 100 to form a fixing nip N, and a protective element (thermo-switch) 104 provided on the surface of the heater so that a heat-sensitive surface thereof contacts the surface of the heater 100.

The pressing roller 103 is rotationally driven, by an unshown driving motor or the like as a driving means, in the counterclockwise direction indicated by an arrow in FIG. 1B at a predetermined peripheral speed. By a press-contact frictional force at the fixing nip N between the outer surface of the pressing roller 103 and the fixing film 102, a rotational force of the pressing roller 103 acts on the cylindrical fixing film 102, so that the fixing 102 is placed in a state in which the fixing film 102 is rotated by rotation of the pressing roller 103. The fixing film 102 is rotated around the heater holder 101 in the clockwise direction indicated by an arrow in FIG. 1B while being slid in close contact with a downward surface of the heater 100 at an inner surface thereof.

A temperature of the heater 100 is increased up to a predetermined temperature (control target temperature) by supplying electric power to the heater 100, and then temperature control is effected for maintaining the heater temperature at the predetermined temperature. In this temperature-controlled state, the sheet 21 on which an unfixed toner image T is carried is fed in a sheet feeding direction (leftward direction in (b) of FIG. 1). In the fixing nip N, a toner image-carrying surface of the sheet 21 hermetically contacts the outer surface of the fixing film 102 and then the sheet 21 is nipped and fed together with the fixing film 102 through the fixing nip N. In this nip-feeding process of the sheet 21, heat of the heater 100 is imparted to the sheet 21 via the fixing film 102, so that the unfixed toner image T on the sheet 21 is heated and pressed to be melt-fixed. The sheet 21 passing through the fixing nip N is curvature-separated from the fixing film 103.

Figure 1C:
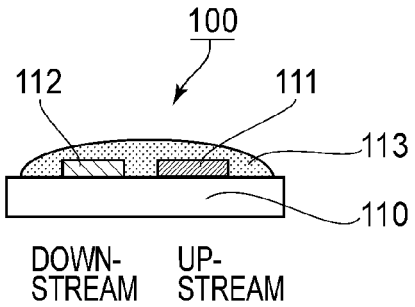

FIG. 1C is an enlarged sectional view of the heater 100. The heater 100 is a ceramic heater of a back-surface heating type. The ceramic heater 100 is constituted by an insulating substrate of a ceramic material such as SiC, AlN or $Al_2O_3$, a first heat generating element 111 and a second heat generating element 112 which are formed on the insulating substrate 110, and a protective layer 113, such as glass, for protecting the two heat generating elements 111 and 112. Further, a glass layer for improving a sliding property with the fixing film 102 is formed on a surface, of the insulating substrate 110, opposite from the surface where the heat generating elements 111 and 112 is printed. The sheet 21 is fed from right to left in FIG. 10, and the right side is an upstream side and the left side is a downstream side with respect to the feeding direction of the sheet 21.

Figure 1D:
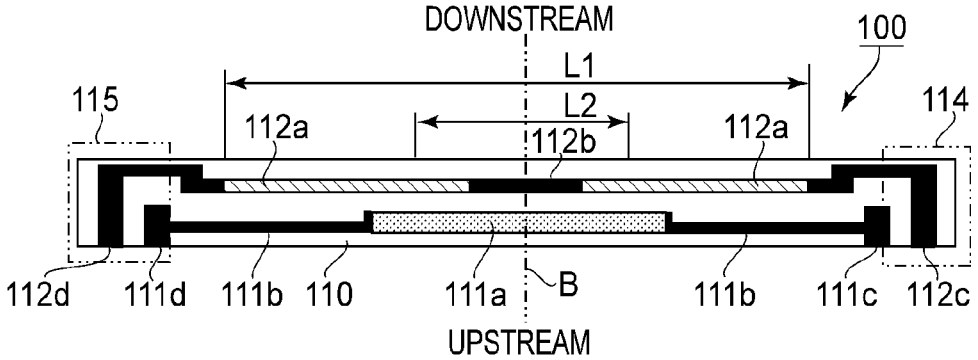

FIG. 1D is a schematic plan view of the heater 100. The first heat generating element 111 includes a heat generating portion, electrodes 111*c* and 111*d*, and electroconductive portions 111*b* for connecting the heat generating portion 111*a* with the electrodes 111*c* and 111*d*, and electric power is supplied to the heat generating portion 111*a* via the electrodes 111*c* and 111*d*, so that the heat generating portion 111*a* generates heat. Similarly, the second heat generating element 112 includes two heat generating portions 112*a*, electrodes 112*c* and 112*d*, and an electroconductive portion 112*b* for connecting the two heat generating portions 112*a*, and the electric power is supplied to the heat generating portions 112*a*, so that the heat generating portions 112*a* generate the heat. Further, the electric power supply is effected via connectors 114 and 115, for electric power supply, each indicated by a chain double-dashed line in FIG. 1D.

A chain line shown in FIG. 1D, is a center feeding reference line in the case where the sheet 21 is fed so that a central portion thereof with respect to a direction perpendicular to the feeding direction of the sheet 21 is aligned with a central portion of the feeding path with respect to the direction perpendicular to the feeding direction. A region L1 is a sheet passing width region of a passable maximum-sized paper, and a region L2 is a sheet passing width region of a passable minimum-sized paper. The sheet passing width is a length of the sheet 21 with respect to the direction perpendicular to the feeding direction of the sheet 21. The heat generating element 111 is principally used for heating the central portion of the sheet 21, and the heat generating element 112 is principally used for heating end portions of the sheet 21.

[Heater Driving Circuit]

Figure 2:
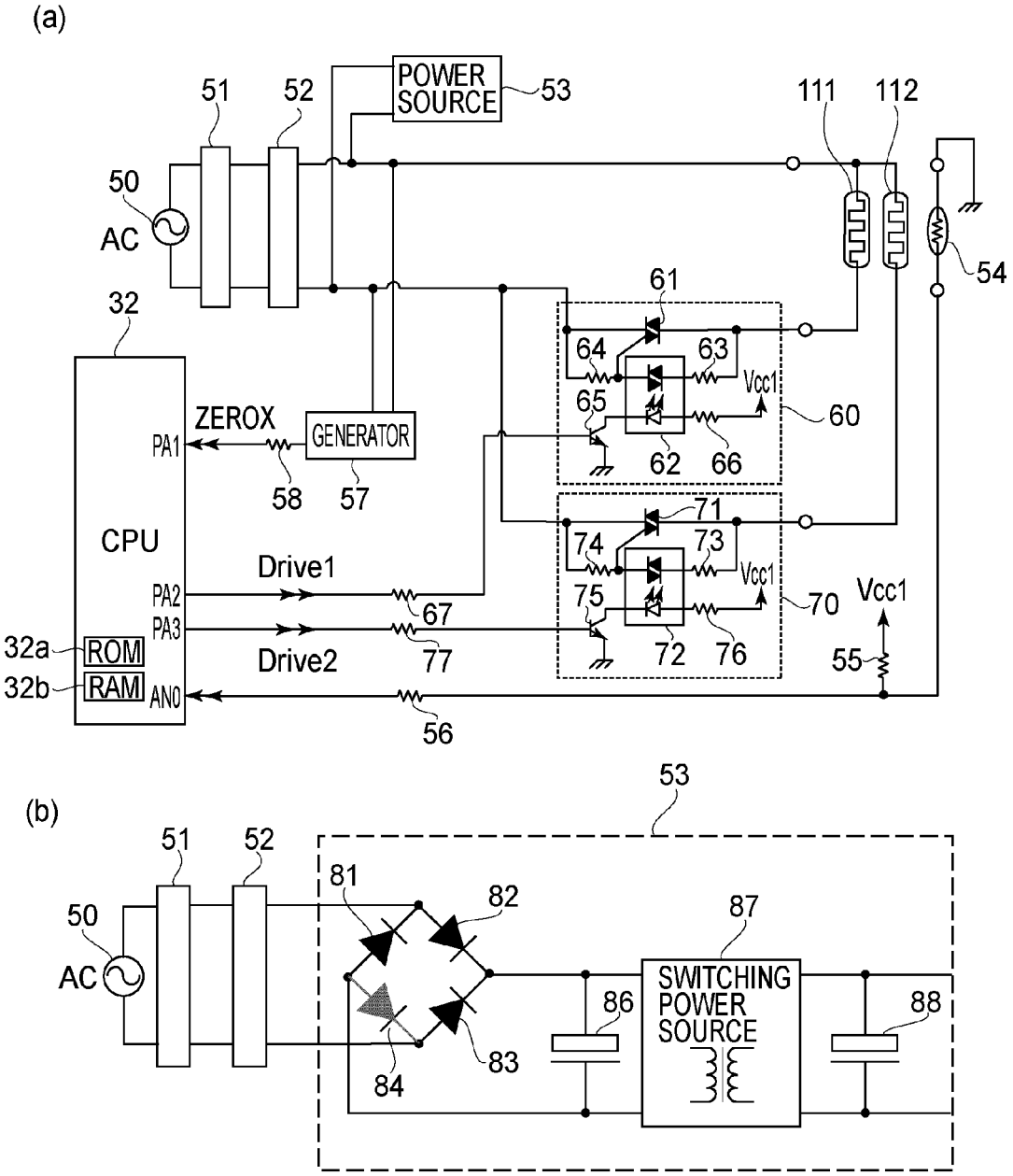
In FIGS. 2, (*a*) and (*b*) are diagrams of a heater driving circuit and a low-voltage power source circuit, respectively, in Embodiment 1.

In FIG. 2, (*a*) is a circuit diagram for illustrating a heater driving circuit in this embodiment. A commercial power source (AC power source) 50 to which the image forming apparatus is to be connected supplies AC electric power to the image forming apparatus via an inlet 51. The heater driving circuit is constituted by a primary-side portion directly connected to the commercial power source 50 and a secondary-side portion connected to the heat generating element 50 in a non-contact manner. The electric power inputted from the commercial power source 50 is supplied to the heat generating elements 111 and 112 via an AC filter 52 to cause the heat generating elements 111 and 112 to generate heat. The electric power of the commercial power source is also inputted into the power source portion 53 via the AC filter 52, so that the power source portion 53 outputs a predetermined voltage to a secondary-side load. The power source portion 53 converts an AC voltage of the commercial power source into a DC voltage and outputs, the DC voltage. For example, the power source portion outputs a voltage of 3 V for driving the CPU 32 or the like and a voltage of 24 V for driving the motor or the like. Further, the CPU 32 is also used in the heater drive control and the like, and is constituted by input and output ports, the ROM 32*a*, the RAM 32*b*, and the like.

In the image forming apparatus, in the primary side of the electric power supplying circuit, a constitution in which the heat generating elements 111 and 112 of the fixing device 30 and a power source unit (power source portion) 53 for supplying the electric power to the secondary side are directly connected with the commercial power source to be supplied with the electric power is employed. Further, in the secondary side of the electric power supplying circuit, a constitution in which the motor and units, to be operated during image formation, such as the motor for rotating the photosensitive drums 13 and the intermediary transfer belt 19, and the laser scanners 11 and the like are connected with the commercial power source in the non-contact manner to be supplied with the electric power is employed.

The heat generating elements 111 and 112 are driven by triac driving circuits 60 and 70. A temperature detecting element 54 provided on the back surface of the heater is connected to the ground at one end thereof and is connected to a resistor 55 at another end thereof, and is further connected to an analog input port AN0 of the CPU 32 via a resistor 56. The temperature detecting element 54 has a property that a resistance value is lowered when a temperature thereof is high. The CPU 32 detects the temperature of the heater 100 by converting information on an inputted voltage value into a temperature on the basis of a temperature table (not shown) preset from a divided voltage of the temperature detecting element and the resistor 55.

An AC waveform supplied from the commercial power source 50 is detected by a zero-cross generating circuit 57 via the AC filter 52. The zero-cross generating circuit 57 has a constitution in which a high level signal is outputted when a voltage of a commercial power source 50 is not more than a threshold voltage in the neighborhood of 0 V, and a low level signal is outputted in other cases. Then, into an input port PA1 of the CPU 32, a pulse signal with a period substantially equal to a period of the commercial power source 50 is inputted via a resistor 58. The pulse signal outputted from the zero-cross generating circuit 57 to the CPU 32 is a zero-cross signal ("ZEROX"). The CPU 32 detects an edge where a zero-cross signal is changed from the high level to the low level, and use the detected edge in control of the heater.

The CPU 32 determines the ON-timing when the triac driving circuits 60 and 70 are driven on the basis of the temperature detected by the temperature detecting element 54, and then outputs driving signals Drive 1 and Drive 2. First, the triac driving circuit 60 as a first driving circuit for supplying and blocking the electric power to the heat generating element 111 will be described. During the heater ON-timing, depending on the detected temperature, when the CPU 32 outputs the high level signal from an output port PA21, the high level signal is inputted into a base of a transistor 65 via a base resistor 67, so that the transistor 65 is turned on. When the transistor 65 is turned on, a photo-triac coupler 62 is in an ON state. Incidentally, the photo-triac coupler 62 is a device for ensuring a creepage distance between the primary side and the secondary side, and a resistor 66 is a resistor for limiting a current passing through a light-emitting diode in the photo-triac coupler 62.

Resistors 63 and 64 are bias resistors for a bi-directional thyristor (triac) 61, and the triac 61 is in an electric conduction state by turning on the photo-triac coupler 62. The triac 61 is an element held, when an ON-trigger functions during the electric power supply from the commercial power source 50, in the electric conduction state until the AC voltage becomes zero volts. As a result, the electric power depending on the ON-timing of the triac 61 is to be supplied to the first heat generating member 111.

A constitution of the triac driving circuit 70 as a second driving circuit for supply and blocking the electric power to the second heat generating element 112 is the same as that of the triac driving circuit 60, and therefore will be omitted from description. As described above, the first heat generating element 111 and the second heat generating element 112 are controlled independently of each other.

[Power Source Unit]

Next, with reference to (b) of FIG. 2, the power source unit (power source portion) 53 (a broken line portion in (b) of FIG. 2) will be described. The voltage of the commercial power source 50 is inputted to diode bridges 81 to 84 via the inlet 51 and the AC filter 52. The AC voltage inputted in the diode bridges 81 to 84 is subjected to full-wave rectification and then is smoothened by a smoothing capacitor 86. The voltage smoothened by the smoothing capacitor 86 is inputted into a switching power source 87, which is a DC-DC converter, so that the switching power source 87 outputs a secondary-side voltage. In the switching power source 87, an insulated type transducer is used for ensuring electrical insulation between the primary and secondary sides. The voltage outputted from the switching power source 87 is smoothened by the smoothing capacitor 88 and is outputted as a secondary-side voltage.

[Control of Electric Power Supply to Heater]

The CPU (controller) 32 sets a duty ratio (level) of the electric power depending on a detected temperature of the temperature detecting element 54 for every one control period, which is a plurality of periods of an AC waveform of the commercial power source 50. The driving circuits 60 and 70 are controlled by the CPU 32 so that the electric power supplied to each of the first and second heat generating elements 111 and 112 provides the duty ratio set by the CPU 32.

Figure 3:
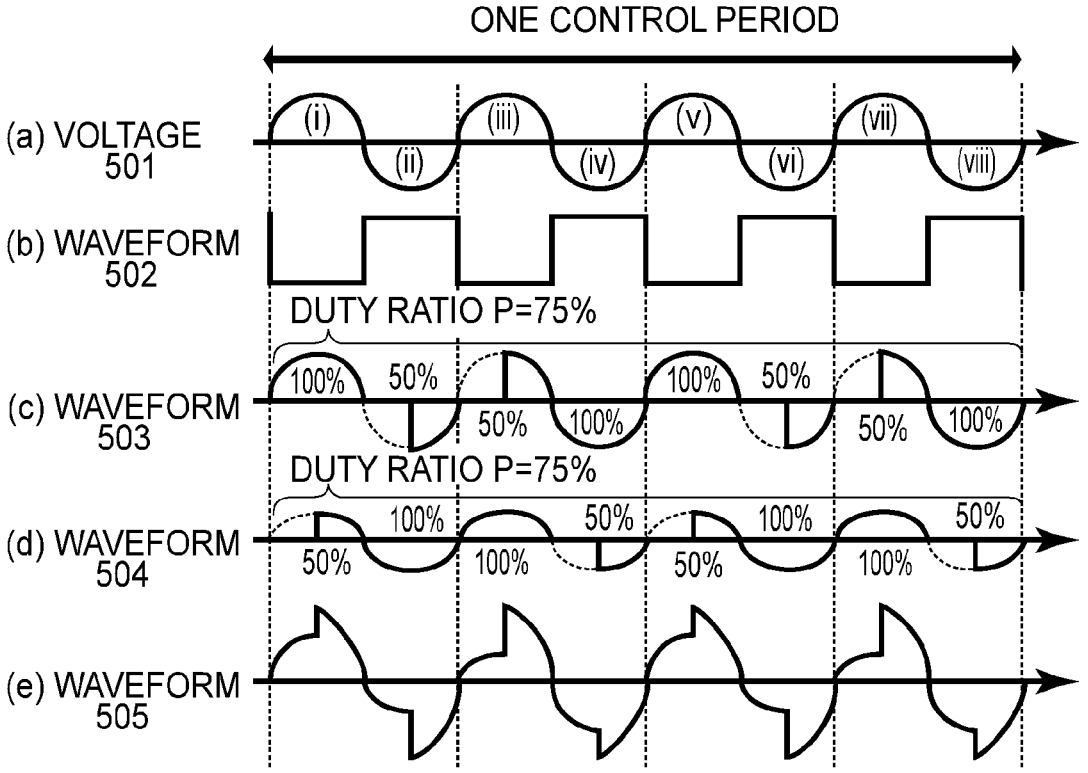
In FIG. 3, (*a*) to (*e*) are waveform charts each showing a supplied electric power pattern to the heater in Embodiment 1.

Specifically, the electric power control by the CPU 32 in the case where the electric power of the duty ratio P=75% is intended to be supplied to the heater 100 (in the case where a level of the total electric power supplied to the first and second heat generating elements 111 and 112 corresponds to the duty ratio of 75%) will be described using each of operational waveforms in 4 full-wave periods of the commercial power source voltage. The 4 full waves of the commercial power source voltage refer to a voltage that correspond to 4 periods of the commercial power source voltage, and is 8 half waves in terms of the half wave. In FIG. 3, (a) shows a waveform of an AC voltage of the commercial power source 50 (hereinafter, this voltage is referred to as a commercial power source voltage 501). In (a) of FIG. 3, each of (i) to (viii) represents the number of the associated one of the 8 half waves. In FIG. 3, (b) shows a waveform of a zero-cross signal 502 outputted from the zero-cross generating circuit 57. In FIG. 3, (c) shows a waveform of a current passing through the first heat generating element 111, and (d) shows a waveform of a current passing through the second heat generating element 112. In FIG. 3, (e) shows a resultant waveform 505 of the currents passing through the first and second heat generating elements 111 and 112. The abscissa represents time.

When the commercial power source voltage 501 is inputted into the zero-cross generating circuit 57, the zero-cross generating circuit 57 generates a zero-cross signal 502 and outputs the zero-cross signal 502 to the CPU 32. In this embodiment, the 4 full waves constitute one control period. When the current having a phase control waveform (waveform such that the current flows from a halfway point of the half wave) is passed through one of the heat generating elements every half wave, electric power supply control such that the electric power supply of 100% (full energization (electric conduction)) is carried out for the other heat generating element or the electric power supply is not carried out (i.e., the electric power supply of 0% (non-energization) is carried out) for the other heat generating element is effected.

In FIG. 3, each of (c) and (d) shows a waveform such that in an equiphase half wave over the periods of the one control period, the current is passed through one of the heat generating elements from a halfway point of the half wave, and is passed through or is not passed through the other heat generating element throughout the half wave period. For example, in the period of the half wave (i), the current is passed through the first heat generating element throughout the half wave period, and the current is passed through the second heat generating element from the halfway point of the half wave period. A rule of the current waveforms that pass through the first and second heat generating elements, respectively, and that provide a relationship between (c) and (d) of FIG. 3 is a first rule. In this embodiment, at least 2 half waves of the 8 half waves in the one control period constitute phase-controlled waveforms. For example, the following electric power supply control is effected in this embodiment. That is, in the first half wave (half wave (i)) in the one control period, the electric power is supplied to the second heat generating element 112 in a phase control manner (supplied electric power: 50%) ((d) of FIG. 3), and the electric power of 100% is supplied to the first heat generating element 111 ((c) of FIG. 3). The supplied electric power of 50% in each half wave also means that an electric power duty ratio in each half wave is 50%. Further, in the second half wave (half wave (ii)) in the one control period, the electric power is supplied to the first heat generating element 111 in the phase control manner (supplied electric power: 50%) ((c) of FIG. 3), and the electric power of 100% is supplied to the second heat generating element 112 ((d) of FIG. 3). In this way, in the periods of the one control period (periods of the half waves (i) to (viii)), the phase-controlled waveforms are alternately set for the first and second heat generating elements.

In the case where the electric power of 75% is supplied to the heater 100, the CPU 32 determines the supplied electric power (electric power duty ratio) every half wave so that the average supplied electric power for 4 full waves (half waves (i) to (viii)) is 75% for each of the first and second heat generating elements. That is, the CPU 32 sets the current waveform for each of the half waves. Hereinafter, a pattern such that the electric power supplied to the first heat generating element or the second heat generating element is set in each of the half waves in the one control period is referred to as a supplied electric power pattern. As shown in (c) of FIG. 3, the supplied electric power pattern to the first heat generating element 111 is such that the supplied electric power is determined every half wave as in the current waveform 503 (in the order of 100%, 50%, 50%, 100%, 100%, 50%, 50% and 100%). Further, as shown in (d) of FIG. 3, the supplied electric power pattern to the second heat generating element 112 is such that the supplied electric power is determined every half wave as in the current waveform 504 (in the order of 50%, 100%, 100%<50%, 50%, 100%, 100% and 50%). In ROM 32*a* in the CPU 32, a table of ON-timing factors (coefficients) of a control portion for the supplied electric power is stored, and the CPU 32 calculates an ON-timing using the table stored in the ROM 32*a*. The table stored in the ROM 32*a* is, e.g., as shown in Table 1. In Table 1, the left column represents the duty ratio (%) of the supplied electric power, and the right column represents the ON-timing factor corresponding to the duty ratio (%). In Table 1, the ON-timing factor of 0 corresponds to the case where a phase of the waveform of the commercial power source voltage 501 is 0°, and the ON-timing factor of 1 corresponds to the case where the phase of the waveform of the commercial power source voltage 501 is 180°. For this reason, Table 1 is also the table showing the correspondence between the phase of the waveform of the commercial power source voltage 501 and the duty ratio (%) of the supplied electric power.

TABLE 1

(ON-timing table)

| SUPPLIED ELECTRIC POWER | ON-TIMING FACTOR |
|---|---|
| 0% | 1 |
| 20% | 0.664 |
| 40% | 0.550 |
| 50% | 0.5 |
| 60% | 0.450 |
| 80% | 0.336 |
| 100% | 0 |

The CPU 32 converts the phase of the ON-timing into a time, on the basis of the table (Table 1), by multiplying a half period of the waveform of the commercial power source voltage 501 detected by the zero-cross signal 502 by the ON-timing factor. For example, when the frequency of the commercial power source voltage 501 is 50 Hz and the ON-timing for supplying the electric power of 50% is converted into the time, the ON-timing is calculated as after a lapse of 5.0 ms (milliseconds) (=20 ms/2×0.5) from the timing when the zero-cross signal is detected. The CPU 32 outputs a high-level signal to the output port PA2 or PA3 after the lapse of 5.0 ms from the time when the level of the zero-cross signal 502 is changed from the high level to the low level or from the low level to the high level. As a result, the CPU 32 supplies the electric power of 50% to the first heat generating element 111 or the second heat generating element 112. In this way, by supplying the electric power every half wave depending on the supplied electric power pattern of each heater, it is possible to supply the electric power of 75% to the heater 100 in the 4 full waves.

[Power Source Current Supply Timing and Electric Power Supply Timing to Heater]

Figure 4:
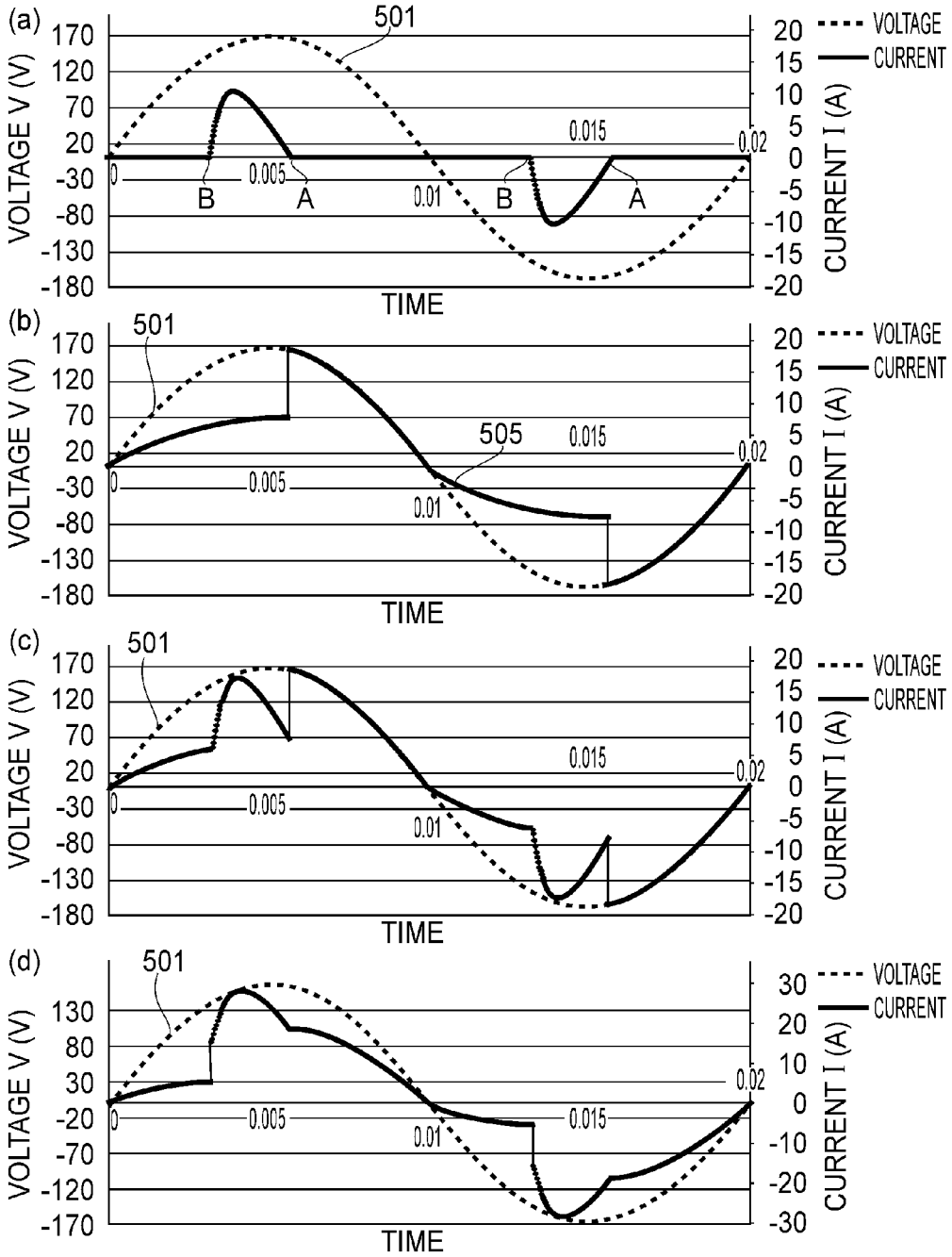
In FIG. 4, (*a*) to (*d*) are waveform charts each showing a power source current, a resultant current of the heater and an inlet current in Embodiment 1.

In FIG. 4, (a) is a graph, in which the abscissa represents the time, showing the commercial power source voltage 501 inputted into the image forming apparatus and the current passing through the surface unit (power source portion) 53. In (a) of FIG. 4, the commercial power source voltage 501 is indicated by a broken line, and the current (power source current) passing through the power source unit 53 is indicated by a solid line. Further, the left-side ordinate represents the voltage V (V), and the right-side ordinate represents the current I (A), and these are also true for (b) to (d) of FIG. 4. In the case of the power source unit (power source portion) 53 in which the power factor improving circuit is not mounted, the current starts to flow at point B as in the current waveform in (a) of FIG. 4, and the flow of the current stops at point A. Thus, the point B is the current supply starting timing, and the point A is the current supply ending timing. As shown in this figure, when a current conduction angle is narrowed and the voltage waveform and the current waveform are dissociated, the power factor decreases.

In FIG. 4, (b) is a graph, in which the abscissa represents the time, showing the commercial power source voltage 501 inputted into the image forming apparatus and a waveform showing a heater resultant current (total current passing through the first and second heat generating elements). The heater resultant current in this figure is a current in the case of a supplied electric power pattern in which when the electric power is supplied to one of the heat generating elements by phase control, the electric power of 100% or 0% is supplied to the other heat generating element. The heater resultant current waveform shown in (b) of FIG. 4 corresponds to the resultant current waveform 505 shown in (e) of FIG. 3. In FIG. 4, (b) is the graph showing the resultant current waveform in the case where the current having the phase-controlled waveform is started to be passed through the first heat generating element or the second heat generating element from the supply ending timing (timing of A in (a) of FIG. 4) of the power source current. For example, in the case where the electric power supply control is effected in the supplied electric power pattern as shown in FIG. 3, in the first half wave (half wave (i)) in the one control period, the electric power of 100% is supplied to the first heat generating element 111, and the electric power of 50% is supplied to the second heat generating element 112. The electric power is supplied, from the phase of 90° to the phase of 180° (in the case where the duty ratio of 50%, the electric power supply start phase is 90°), to the second heat generating element 112, which is the heat generating element through which the current of the phase-controlled waveform is to be passed, and is not supplied from the phase of 0° to the phase of 90°. In this way, in the case where the control shown in FIG. 3 is effected, there is a period (e.g., from the phase of 0° to the phase of 90°) in which the heat generating element through which the current of the phase-controlled waveform is to be passed is turned off, and therefore the voltage waveform and the current waveform are dissociated from each other, so that the power factor decreases.

In FIG. 4, (c) is a graph showing the commercial power source voltage 501 inputted into the image forming apparatus and the waveform of an inlet current. The inlet current is a resultant current of the current passing through the power source unit (predetermined portion) 53 and the current passing through the heater 100. The power source current shown in (a) of FIG. 4 and the heater resultant current shown in (b) of FIG. 4 are synthesized, so that the inlet current approaches the commercial power source voltage 501 and thus the power factor is improved. In this way, in synchronism with the current supply ending timing (timing of A) of the power source current, the supply of the electric power of the phase-controlled waveform to the heat generating element is started, so that a high power factor can be achieved.

In FIG. 4, (d) is a graph showing an inlet current waveform in the case where the supply of the electric power of the phase controlled waveform to the heat generating element at a timing substantially the same as the current supply starting timing (timing of B in (a) of FIG. 4) of the power source current. In this case, the current abruptly fluctuates at the timing of B. Accordingly, the dissociation is generated between the inlet current waveform and the commercial power source voltage 501, so that the power factor decreases.

[Relationship Between Supplied Electric Power and Power Factor]

Figure 5:
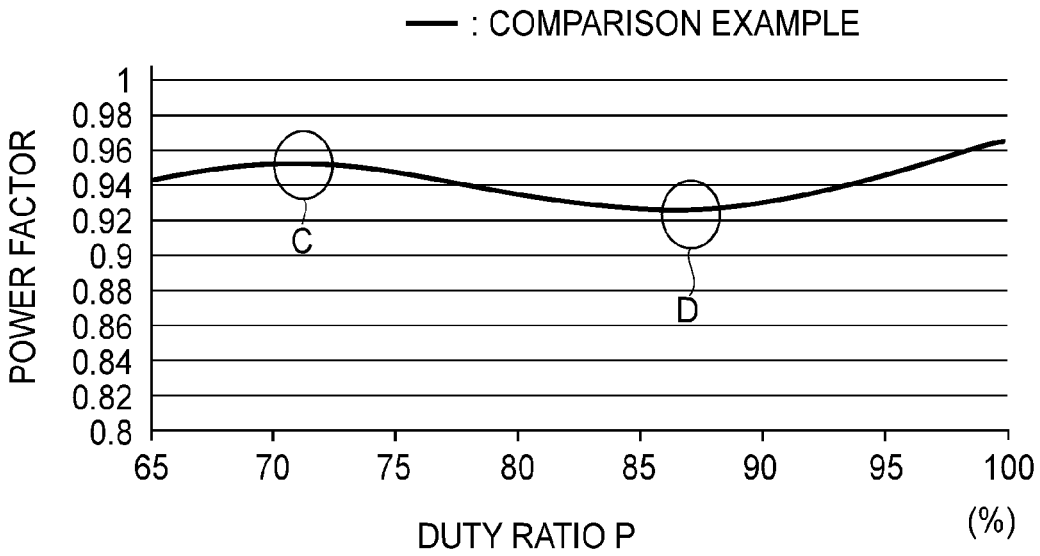
In FIGS. 5, (*a*) and (*b*) are graphs showing relationships, in Embodiment 1 and Comparison Example, respectively, between supplied electric power and a power factor.
Figure 5:
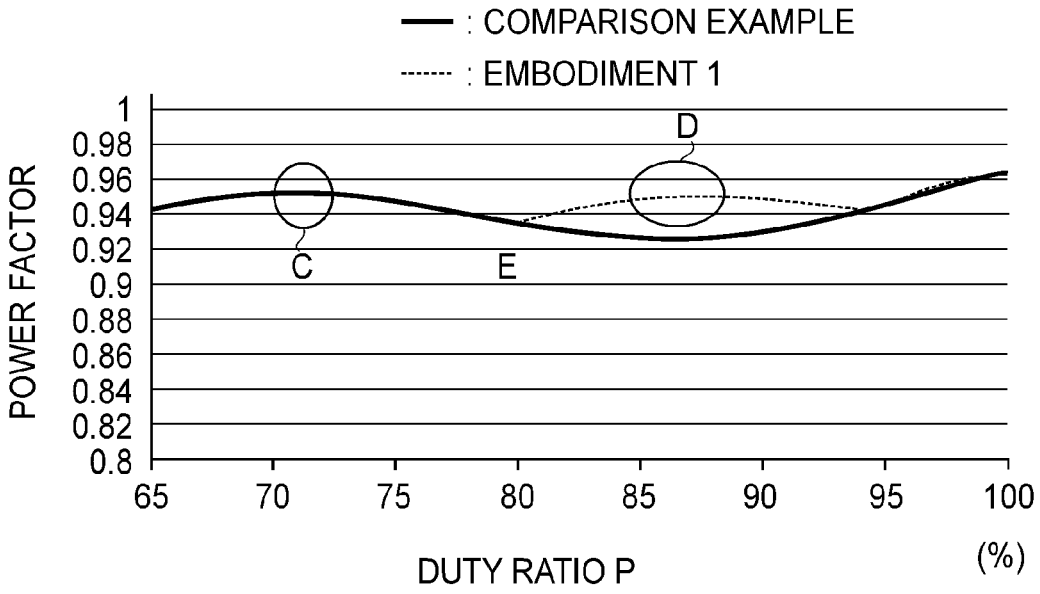

In FIG. 5, (a) and (b) are graphs each showing a relationship between the duty ratio of the supplied electric power and the power factor. In FIG. 5, (a) is the graph, in which the abscissa represents the duty ratio of the supplied electric power, showing the power factor in a supplied electric power pattern in a Comparison Example in which when the electric power is supplied to one of the heat generating elements in the phase-controlled manner, the electric power of 100% or 0% is supplied to the other heat generating element. In (a) of FIG. 5, in the neighborhood of point C, i.e., in the neighborhood of the point where the duty ratio of the supplied electric power is 70%, the power factor is improved. The point C is a supplied electric power point where the supply starting timing of the electric power by the phase control coincides with the supply ending timing of the power source current. The supplied electric power pattern is, e.g., as shown in (a) of FIG. 6. In FIG. 6, (a) shows the duty ratio of the supplied electric power in each of half waves for each of the first and second heat generating elements 111 and 112 and shows the supplied electric power duty ratio in the 8 half waves constituting the one control period. In (a) of FIG. 6, P represents a positive half wave, and N represents a negative half wave. Further, a first full wave P corresponds to a first half wave (half wave (i)), and a second full wave N corresponds to a second half wave (half wave (ii)). These are also true for tables of (b) to (d) of FIG. 6.

In the supplied electric power pattern shown in (a) of FIG. 6, over the periods of the one control period, when the electric power 100% is supplied to one heat generating element, the electric power of 40% is supplied to the other heat generating element in the phase-controlled manner, and the phase-controlled electric power supply is started in the neighborhood of the supply ending timing of the power source current (waveform of rule 1). In the supplied electric power pattern shown in (a) of FIG. 6, an average supplied electric power duty ratio is 70%. In the case where the electric power is supplied in the supplied electric power pattern shown in (a) of FIG. 6, the inlet current waveform is as shown in (c) of FIG. 4 and approaches the commercial power source voltage 501, and therefore the power factor is improved.

On the other hand, in (a) of FIG. 5, in the neighborhood of point D, i.e., in the neighborhood of the point where the duty ratio of the supplied electric power is 85%, the power factor is lowered. The point D is a supplied electric power point where the supply starting timing of the electric power by the phase control for one of the heat generating elements coincides with the supply starting timing of the power source current. The supplied electric power pattern is, as shown in (b) of FIG. 6.

Also in the supplied electric power pattern shown in (b) of FIG. 6, over the periods of the one control period, when the electric power 100% is supplied to one heat generating element, the electric power of 70% is supplied to the other heat generating element, and the phase-controlled electric power supply is started in the neighborhood of the supply starting timing of the power source current (waveform of rule 1). In the supplied electric power pattern shown in (b) of FIG. 6, an average supplied electric power duty ratio is 85%. In the case where the electric power is supplied in the supplied electric power pattern shown in (a) of FIG. 6, the inlet current waveform is as shown in (d) of FIG. 4 and is dissociated from the commercial power source voltage 501, and therefore the power factor is lowered. In this way, in the case where the electric power is supplied by the waveform of the rule 1, the power factor is high when the duty ratio of the total electric power supplied to the first and second heat generating elements is about 70%, but is lowered when the duty ratio is about 85%. In this embodiment, a constitution in which the half wave such that the electric power supply to the heat generating element is started in the neighborhood of the supply starting timing of the power source current is decreased and in which the half wave such that the electric power supply to the heat generating element is started in the neighborhood of the supply ending timing of the power source current is increased is employed. As a result, in this embodiment, a high power factor is realized. That is depending on the duty ratio of the total electric power supplied to the first and second heat generating elements, the rule of the AC waveform passed through the first and second heat generating elements.

[Supplied Electric Power Pattern in this Embodiment]

Next, the supplied electric power pattern in this embodiment will be specifically described with reference to (b) and (c) of FIG. 6. In this embodiment, as in the supplied electric power pattern in (c) of FIG. 6, the half wave in which the duty ratio is 70% in the supplied electric power pattern in (b) of FIG. 6 is replaced, in the neighborhood of the supply ending timing of the power source current, with the half wave in which the duty ratio is 40% where the power factor is good or the half wave in which the duty ratio is 100% where the power factor is originally good. In the supplied electric power pattern shown in (c) of FIG. 6, the average supplied electric power is 85%, similar to the supplied electric power pattern shown in (b) of FIG. 6. In the supplied electric power pattern in (c) of FIG. 6, a waveform of a second rule in which there is in an equiphase half wave of at least a part of the periods of the one control period, the current is passed through both of the first and second heat generating elements throughout the half wave period.

For example, in the first full wave P (half wave (i)) in (b) of FIG. 6, the electric power of 70% in duty ratio is supplied to the second heat generating element 112, and on the other hand, in the first full wave P (half wave (ii)) in (c) of FIG. 6, the electric power of 40% in duty ratio is supplied to the second heat generating element 112. Further, in the first full wave N (half wave (ii)) in (b) of FIG. 6, the electric power of 70% in duty ratio is supplied to the first heat generating element 111, and on the other hand, in the first full wave N (half wave (ii)) in (c) of FIG. 6, the electric power of 100% in duty ratio is supplied to the first heat generating element 111. In this embodiment, by employing such a constitution, even in the case where the average supplied electric power to the entire heater 100 in the one control period is 85%, it becomes possible to achieve a high power factor.

In FIG. 5, (b) is a graph showing the power factor in the supplied electric power pattern in a Comparison Example indicated by a solid line and the power factor in the supplied electric power pattern in Embodiment 1 indicated by a broken line. In the neighborhood of the point D in (b) of FIG. 5, it is understood that the power factor in the supplied electric power pattern in Embodiment 1 is improved compared with the case of the Comparison Example. In this embodiment, the high power factor is achieved by starting the electric power supply by the phase control at the supply ending timing of the power source current in the supplied electric power pattern in the 4 full-wave period and by using the duty ratio of 100% where the power factor is originally good. In addition to this method, the following method may also be used. That is, by prolonging the length of the one control period, the power factor can be improved even at the duty ratio where the power factor is lowered as in the case of point E in (b) of FIG. 5. For example, the one control period is constituted by 8 full-wave period (i.e., the one control period is constituted by 16 half waves), and thus the supplied electric power pattern at the point C and the supplied electric power pattern at the point D are combined, so that the power factor at the point E can be improved.

As the supply ending timing of the power source current in this embodiment, the supply ending timing of the power source current prepared in advance is used. However, the supply ending timing of the power source current changes also depending on the power source voltage and the power source current, and therefore the supply ending timing may also be changed depending on the commercial power source voltage 501, the inlet current, a sequence of the image forming apparatus, and the like, and is not limited to that in this embodiment.

As described above, by using the supplied electric power pattern based on the supply ending timing of the power source current, it becomes possible to realize the high power factor even in the power source provided with no power factor improving circuit. The number of the heat generating elements for the heater 100, the length of the one control period and the setting method of the supplied electric power are not limited to those described in this embodiment.

[Power Control Process for Improving Power Factor]

Figure 7:
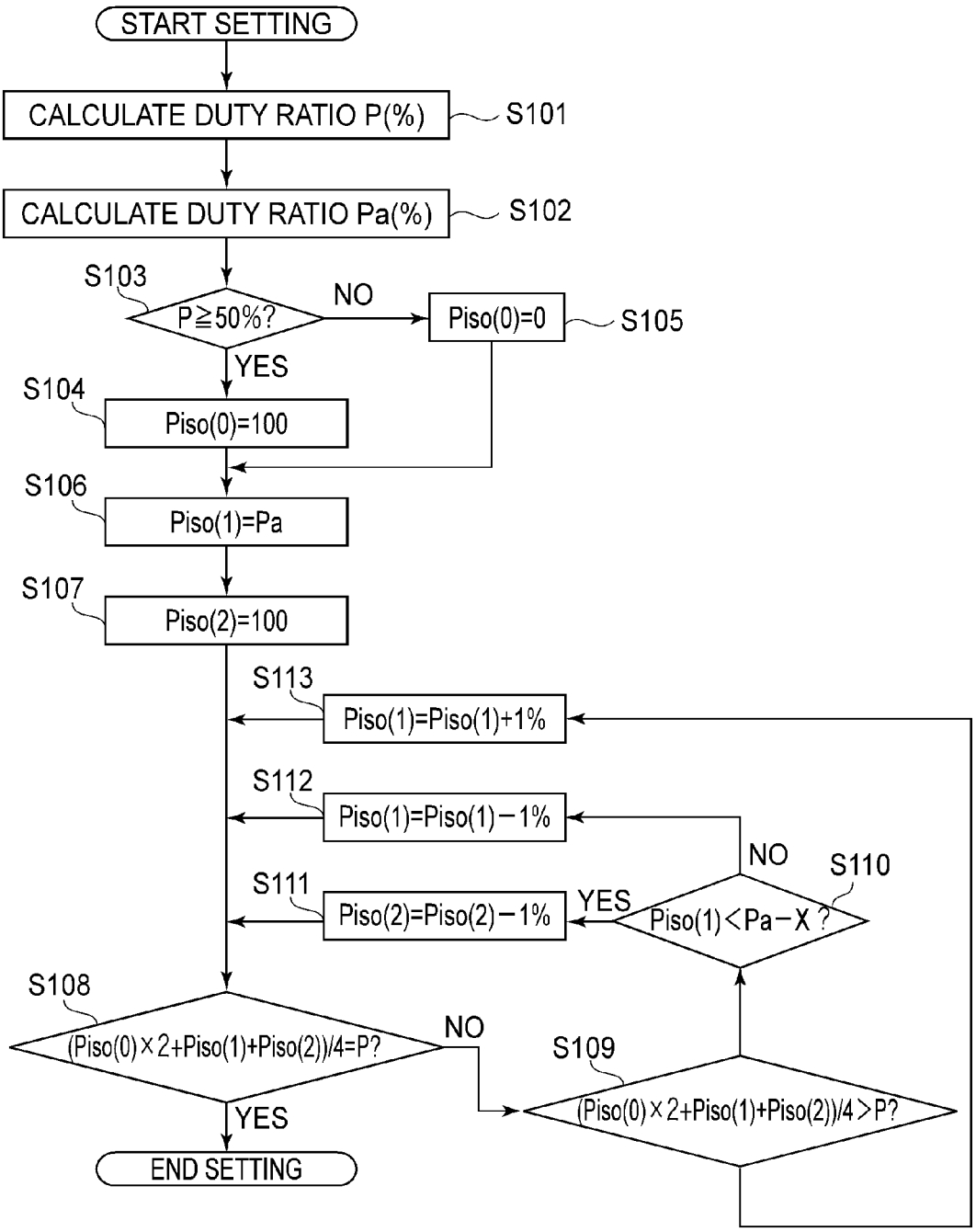
FIG. 7 is a flowchart showing a process of setting the supplied electric power pattern in Embodiment 1.

FIG. 7 is a flowchart for illustrating a sequence for setting the supplied electric power pattern for improving the power factor. In FIG. 6, (*d*) is a basic table of the supplied electric power pattern in this embodiment and is stored in, e.g., the ROM 32*a*. The basic table in (d) of FIG. 6 is constituted by the following 3 components. First, the basic table of (d) of FIG. 6 is constituted by Piso(0) in which the supplied electric power is 100% ("AE" (all energization) in the figure) or 0% ("NE" (non-energization) in the figure). Further, the basic table in (d) of FIG. 6 is constituted by Piso(1) in which the electric power is supplied by first phase control ("PHS1" (phase 1)) and Piso(2) in which the electric power is supplied by second phase control ("PHS2" (phase 2)). By using the basic table in (d) of FIG. 6, the process for setting the supplied electric power pattern for improving the power factor will be described along the flowchart.

In step S101, the CPU 32 calculates a duty ratio P (%) of the supplied electric power to the heater 100 (i.e., the duty ratio of the total electric power supplied to the first and second heat generating elements) on the basis of a set temperature of the heater 100, i.e., a target temperature in temperature control, and a present temperature detected by the temperature detecting element 54. The duty ratio P (%) calculated by the CPU in S101 is the average supplied electric power supplied to the entire heater 100 in the one control period, and, e.g., in the case of (c) of FIG. 6, the duty ratio P is 85%. In S102, the CPU 32 calculates a duty ratio Pa of the phase-controlled waveform in which the power factor is most improved (hereinafter, referred to as a power factor-improving duty ratio), from the supply ending timing of the power source current prepared in advance. The duty ratio P in the duty ratio in a one control period unit, and on the other hand, the duty ratio Pa is the duty ratio in a half wave unit. As described with reference to (b) and (c) of FIG. 6, in the case where the supplied electric power (P %) is 85%, the power factor is lowered when the supplied electric power in one half wave is 70% and is improved when the supplied electric power in one half wave is 40%. In such a case, the CPU 32 calculates the power factor-improving duty ratio Pa as 40%. Also in the case where the calculated duty ratio P is less or more than 85%, not 85%, Pa is set at 40%. In this embodiment, the supply ending timing of the power source current prepared in advance is stored in, e.g., the ROM 32*a*.

In S103, the CPU 32 discriminates whether or not the duty ratio P is 50% or more. In the case where the CPU 32 discriminates that the duty ratio P is 50% or more in S103, the CPU 32 sets Piso(0) at 100% (Piso(0)=100) in S104. In the case where the CPU 32 discriminates that the duty ratio is not 50% or more in S103, the CPU 32 sets Piso(0) at 0% (Piso(0)=0) in S105. For example, in the case where the duty ratio P calculated by the CPU 32 in S101 is 85%, Piso(0)=100 is set. In S106, the CPU 32 sets Piso(1) at the power factor-improving duty ratio Pa calculated in S102 (Piso(1)=Pa), and sets Piso(2) at 100% (Piso(2)=100) in S107. For example, in the case where the power factor-improving duty ratio Pa calculated by the CPU 32 in S102 is 40%, Piso(1)=40 is set.

In S108, the CPU 32 discriminates whether or not a duty ratio of average supplied electric power in the 4 full waves set by using the duty ratio Pa (i.e., temperature duty ratio=((Piso(0)×2+Piso(1)+Piso(2))/4) is equal to the duty ratio P calculated in S101. As shown in (c) of FIG. 6, of the 4 full waves, the later 2 full waves have a pattern in which components of the early 2 full waves are reversed, and therefore the duty ratio can be calculated by a Formula: (Piso(0)×2+Piso(1)+Piso(2))/4 (4: the number of the half waves), and this is true for subsequent calculations. In S108, in the case where the CPU 32 discriminates that the temporary duty ratio is not equal to the duty ratio P, the CPU 32 discriminates in S109 whether or not the temporary duty ratio is larger than the duty ratio P. For example, in the case where the duty ratio P calculated in S101 is 83%, not 85%, the duty ratio P is not equal to the temporary duty ratio, and therefore, the sequence transfers from S108 and S109. In S109, in the case where the CPU 32 discriminates that the temporary duty ratio is larger than the duty ratio R, the sequence goes not a process of S110, and in the case where the CPU 32 discriminates that the temporary duty ratio is not larger than the duty ratio P, i.e., smaller than the duty ratio P, the sequence goes to a process of S113. In the case where the sequence transfers from S108 and S109, the temporary duty ratio calculated as Piso(1)=Pa does not coincide with the duty ratio P. Therefore, there is a need to correct Piso(1) in order that the temporary duty ratio coincides with the duty ratio P. In the case where Piso(1) is not equal to Pa, the supply starting timing of the current of the phase-controlled waveform is deviated from the supply ending timing (A in FIG. 4) of the power source current, but when a deviation amount is smaller than that with respect to the timing shown in (d) of FIG. 4, the lowering in power factor can be suppressed. Accordingly, Piso(1) is a correctable value, and a threshold X described below is an upper limit of the correction of Piso(1) in consideration of the power factor.

In S110, the CPU 32 discriminates whether or not Piso(1) is smaller than a value (Pa−X) obtained by subtracting a predetermined duty ratio X (%) from the power factor-improving duty ratio Pa. The threshold X is a value of 0-25, preferably a value of 0-15. In S110, in the case where the CPU 32 discriminates that Piso(1) is smaller than the value (Pa−X), the sequence goes to a process of S111. In S110, in the case where the CPU 32 discriminates that Piso(1) is not smaller than the value (Pa−X), the sequence goes to process of S112. In S106, Piso(1)=Pa is set, and therefore in the case where the sequence first goes to S110, the discrimination in S110 is "No", so that the sequence goes to S112.

In S111, the power factor is rather lowered when the value is further subtracted from Piso(1), and therefore the CPU 32 does not subtract the value from Piso(1), but Piso(2) is decreased by 1% (Piso(2)=Piso(2)−1%). On the other hand, in S112, the CPU 22 decreases Piso(1) by 1% (Piso(1)=Piso(1)−1%). Further, in S113, the CPU 32 increases Piso(1) by 1% (Piso(1)=Piso(1)+1%). In the case where the CPU 32 makes the discrimination of "No" in S109, the value cannot be added to Piso(2)=100, and therefore the CPU 32 does not make the discrimination as in S110 but performs the process of S113. In the case where the CPU 32 discriminates that the temporary duty ratio is equal to the duty ratio P in S108, the process is ended. For example, in the case where the duty ratio P is 85% and the duty ratio Pa is 40%, the temporary duty ratio is 85% (=(100×2+40+100)/4), and is equal to the duty ratio P, and therefore the setting process of the supplied electric power pattern is ended.

In this embodiment, the control sequence, the tables and the circuit structure are not limited to those described above. By the electric power control in this embodiment, the supplied electric power pattern based on the supply ending timing of the power source current is set, so that it becomes possible to realize the high power factor even in the power source with no power factor-improving circuit. In this embodiment, the supplied electric power duty ratio P is calculated from the target temperature for effecting the temperature control and the present temperature detected by the temperature detecting element 54, and then the supplied electric power pattern is set. However, a constitution in which an optimum supplied electric power pattern is selected on the basis of the power source current supply ending timing from a plurality of tables of the supplied electric power patterns corresponding to combinations of predetermined duty ratios P with candidates for predetermined duty ratios Pa may also be employed. In this way, the setting method of the supplied electric power pattern is not limited to the method described in this embodiment.

Another Embodiment

In the above-described driving circuit for the heater 100, the triac is used. In the case where the triac is used, as described above, a constitution in which the supply ending timing of the power source current and the supply starting timing of the electric power by the phase control coincide with each other is employed. This embodiment is not limited to the driving circuit using the triac, but can also be applied to a driving circuit using, e.g., a field-effect transistor (FET).

In the case where the FET is used in the driving circuit for the heater 100, the power factor is improved when ON-timing or OFF-timing of the FET is controlled in the following manner. A description is provided with reference to (a) of FIG. 4. As seen in (a) of FIG. 4, the FET is turned on at timing of a phase of 0°, and is turned off at timing of B. Then, the FET is turned on at timing of A, i.e., supply ending timing of the power source current, and is turned off at timing of the phase of 180°. For this reason, in the case where the present invention is applied to the driving circuit using the FET, for setting the supplied electric power pattern, not only the supply ending timing of the power source current but also the supply starting timing of the power source current are needed. The supply starting timing of the power source current may only be required to be stored in advance in, e.g., the ROM 32*a* similarly as in the case of the supply ending timing of the power source current described above. This is true for Embodiment 2.

As described above, according to this embodiment, it is possible to improve the power factor while realizing downsizing of the image forming apparatus and a cost reduction.

Embodiment 2

In Embodiment 1, an example was described in which a supplied electric power pattern is set in which the power factor is improved on the basis of the power factor-improving duty ratio Pa calculated from the supply ending timing of the power source current and in which the electric power supply to the heater 100 is carried out in the supplied electric power pattern in one species of the control period. In general, a maximum current which can be supplied from the commercial power source 50 into the image forming apparatus is limited by standard, so that a high power factor is required only in the case where the current of the inlet 51 is in the neighborhood of the maximum current standard. Further, in order to minimize a temperature ripple as seen in the heater 100, the control period of the electric power supply is required to be shortened. Therefore, in Embodiment 2, an example will be described in which whether or not control for improving the power factor should be effected is discriminated depending on a detection result of the inlet current, and then the control period of the electric power supply and the supplied electric power pattern are switched. The structures of the image forming apparatus and the fixing device 30 are similar to those in Embodiment 1, and therefore the difference from Embodiment 1 will be principally described, and common constitutions will be omitted from description by adding the same reference numerals or symbols.

An inlet current detecting circuit in a heater driving circuit in this embodiment will be described with reference to (a) of FIG. 8. The current flowing into the inlet 51 is inputted into an inlet current detecting circuit 181 via a current transducer 180. In the inlet current detecting circuit 181, the inputted current is converted into a voltage and then is outputted. A current detection signal ("HCRRT1") which is obtained by converting the current into the voltage by the inlet current detecting circuit 181 and which is outputted from the circuit 181 is inputted into an input port PA4 of the CPU 32 via a resistor 182, and then is A/D-converted, so that the signal is controlled as a digital value.

Figure 8:
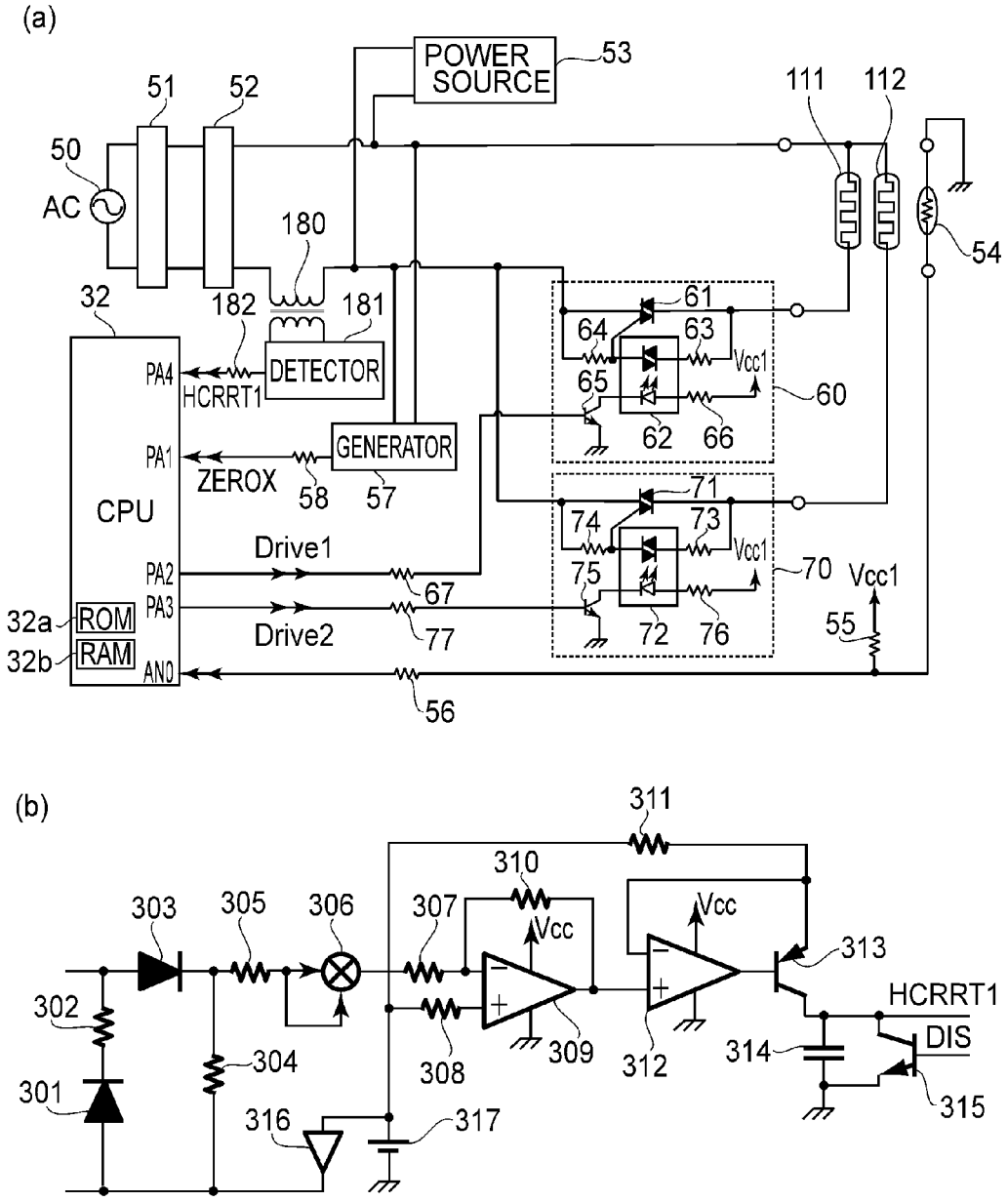
In FIGS. 8, (*a*) and (*b*) are diagrams of a heater during circuit and a low-voltage power source circuit, respectively, in Embodiment 2.
Figure 9:
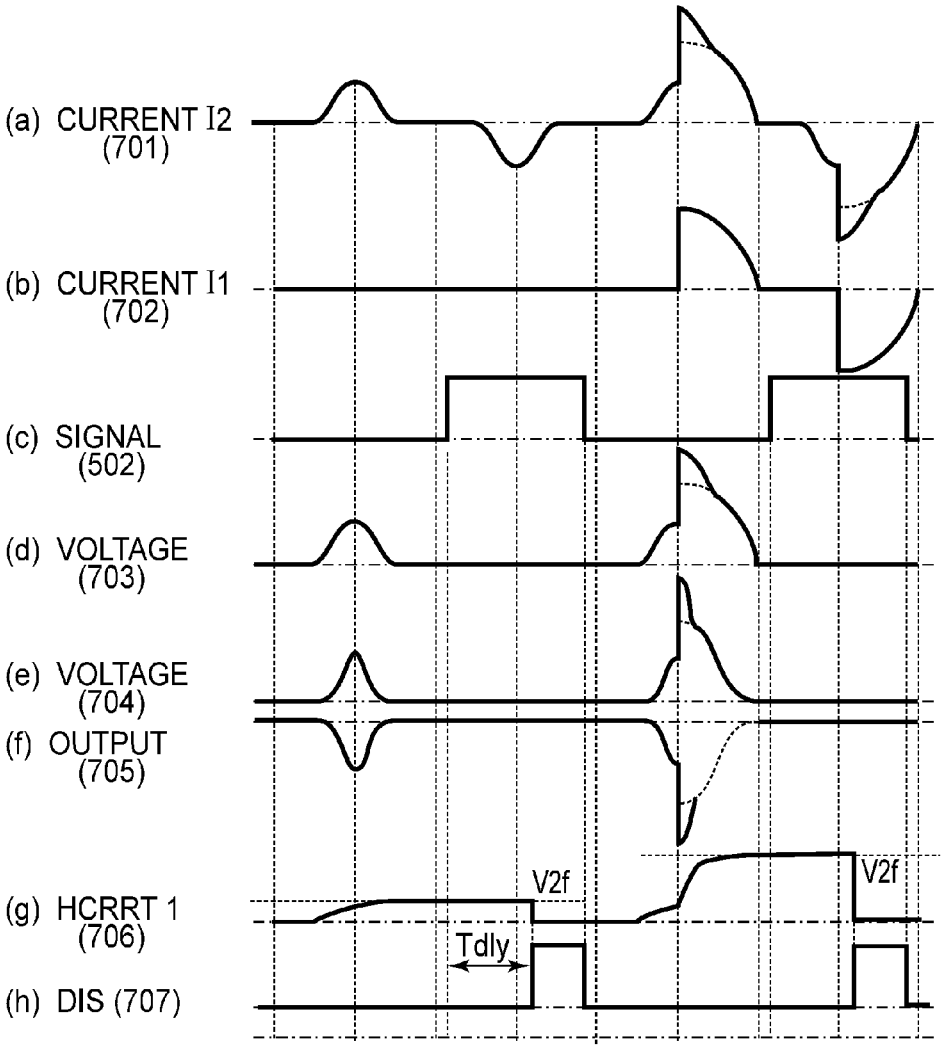
In FIG. 9, (*a*) to (*h*) are waveform diagrams for illustrating an operation of an inlet current detecting circuit in Embodiment 2.

In FIG. 8, (*b*) is a block diagram for illustrating a constitution of the inlet current detecting circuit 181 in this embodiment. FIG. 9 is a waveform chart for illustrating an operation of the inlet current detecting circuit 181 in this embodiment.

Specifically, in FIG. 9, (*a*) shows a current waveform 701 of an inlet current I2 supplied via the inlet 51 and the AC filter 52, and the inlet current I2 is converted into the voltage into the secondary side by the current transducer 180. The inlet current I2 is a resultant current of a heater current I1 passing through the heat generating elements 111 and 112 and a current I3 passing through the power source unit 53 (also referred to as a power source current I3). In FIG. 9, (*b*) shows a current waveform 702 of the heater current I1 (passing through the heat generating elements 111 and 112. In FIG. 9, (*c*) shows a waveform of the zero-cross signal 502 outputted from the zero-cross generating circuit 57. In these figures, the abscissa represents the time.

The voltage outputted from the current transducer 180 is rectified by diodes 301 and 303 of the inlet current detecting circuit 181 shown in (b) of FIG. 8. Resistors 302 and 305 are load resistors. A voltage waveform 703 is a voltage waveform which is subjected to half-wave rectification by the diode 303, and the voltage waveform 703 is inputted into a multiplier 306 via the resistor 305 shown in (b) of FIG. 8. A waveform 704 shown in (e) of FIG. 9 is a voltage waveform squared by the multiplier 306. The squared voltage waveform 704 is inputted into (−) terminal of an operational amplifier 309 via a resistor 307 in (b) of FIG. 8. On the other hand, into (+) terminal of the operational amplifier 309, a reference voltage 317 is inputted via a resistor 308, so that the reference voltage 317 is inverted and amplified by a feedback resistor 310. Incidentally, the operational amplifier 309 is supplied with the electric power from one of the power sources. The waveform inverted and amplified on the basis of the reference voltage 317, i.e., the waveform 705, shown in (f) of FIG. 9, which is an output of the operational amplifier 309 is inputted into (+) terminal of an operational amplifier 312. The inlet current detecting circuit also includes the resistor 304 and a buffer 316. A reference potential of the current transducer 180 is determined from a reference voltage 317 via the buffer 316.

The operational amplifier 312 controls a transistor 313 so that a current determined by a voltage difference between the reference voltage 317 inputted into (−) terminal thereof and the waveform inputted into (+) terminal thereof, and a resistor 311 is caused to flow into a capacitor 314. The capacitor 314 is charged with the current detected by the voltage difference between the reference voltage 317 inputted into (−) terminal and the waveform inputted into (+) terminal of the operational amplifier 312, and the resistor 311.

When a half-wave rectification section by the diode 303 is ended, there is no charging current to the capacitor 314, and therefore a resultant voltage value V2f is peak-held as shown in a waveform 706 in (g) of FIG. 9.

Here, a transistor 315 is turned on in a half-wave rectification period, so that the charging current of the capacitor 314 is discharged. The transistor 315 is turned on and off by a DIS signal outputted from the CPU 32 shown in (h) of FIG. 9 as a waveform 707. On the basis of the zero-cross signal shown in (c) of FIG. 9 as the waveform 502, the CPU 32 controls the transistor 315. The DIS signal outputted from the CPU 21 becomes a high level after a lapse of a predetermined time Tdly from a rising edge of the zero-cross signal, and becomes low level at a falling edge of the zero-cross signal 502. As a result, the CPU 32 is capable of controlling the inlet current detecting circuit 181 without interfering with a heater current period in the half-wave rectification period of the diode 303.

That is, the peak-holding voltage V2f of the capacitor 314 is an integrated value of a squared value, in a half period, of the waveform which is voltage-converted, from the current waveform in the secondary side, by the current transducer 180. Then, the voltage of the capacitor 314 is outputted, as HCRRT1 signal shown in the waveform 706, in (g) of FIG. 9, from the inlet current detecting circuit 181 to the CPU 32. The CPU 32 subjects the HCRRT1 signal 706, inputted from the input port PA4, to A/D conversion until the lapse of the predetermined time Tdly from the rising edge of the zero-cross signal 502. The inlet current I2 subjected to the A/D conversion is a current value for a full wave of the commercial power source voltage, and then the CPU 32 averages the inlet current I2 for 4 full waves of the commercial power source voltage and calculates electric power, to be consumed by the entire apparatus, by multiplying the average value by a coefficient prepared in advance. However, the detecting method of the inlet current I2 is not limited thereto.

In this embodiment, in the case where the inlet current I2 exceeds a predetermined current I4, the CPU 32 discriminates that there is a need to improve the power factor and sets the supplied electric power pattern based on the supply ending timing of the power source current I3 in the 4 full-wave periods described in Embodiment 1. The predetermined current I4 is a value determined in advance on the basis of the inlet current standard. On the other hand, in the case where the inlet current I2 is not more than the predetermined current I4, the CPU 32 discriminates that there is no need to improve the power factor, and gives high priority to shortening of the control period of the electric power supply, so that the CPU 32 sets the supplied electric power pattern in the 2 full-wave periods. In the case where the priority is given to the shortening of the control period, the one control period may only be required to be shorter than the supplied electric power pattern (e.g., 8 half waves) for improving the power factor and may only be required to include at least two half waves for effecting the phase control.

In this embodiment, switching detection of the supplied electric power pattern is made on the basis of the detection result of the inlet current detecting current 181. However, e.g., as in a constitution in which the supplied electric power pattern is switched depending on the commercial power source voltage or in a constitution in which the supplied electric power pattern is switched depending on an operation in a mode such as warm-up made or a print mode, the discrimination is not limited to that in this embodiment. Further, a constitution in which the switching between the supplied electric power pattern based on the supply ending timing of the power source current I3 in the 4 full-wave periods and the supplied electric power pattern based on the supply ending timing of the power source current I3 in the 8 full-wave periods is made depending on the control period or the like of required electric power control may also be employed. In this way, the type and the number of the supplied electric power patterns to be switched are not limited to those in this embodiment.

[Electric Power Control Process for Improving Power Factor]

The control process in this embodiment will be described along a flowchart of FIG. 10. In this embodiment, the steps in which the same processes as those described in Embodiment 1 are represented by the same step symbols and will be omitted from description. In S201, the CPU 32 calculates the average inlet current I2 in the 4 full-wave periods by using the inlet current detecting circuit 181 described with reference to FIGS. 8 and 9. In S202, the CPU 32 compares the inlet current I2 with the predetermined current I4 determined in advance on the basis of the inlet current standard, and thus periods whether or not the inlet current I2 is larger than the predetermined current I4. In S202, in the case where the CPU 32 discriminates that the inlet current I2 is not larger than the predetermined current I4, in S204, the CPU 32 sets the supplied electric power pattern in the second full-wave periods (2 periods) prepared in advance for the supplied electric power pattern.

On the other hand, in S202, in the case where the CPU 32 discriminates that the inlet current I2 is larger than the predetermined current I4, in S203, the CPU 32 sets the control period of the electric power supply at the 4 full-wave periods. Then, the CPU 32 carries out the processes from S102 and S113 as described above, so that the CPU 32 sets the supplied electric power pattern based on the supply ending timing of the power source current I3 in the 4 full waves. In this way, by performing the supplied electric power pattern setting process as shown in FIG. 10, in the case where the inlet current I2 is larger than the predetermined current I4, the supplied electric power pattern based on the supply ending timing of the power source current I3 is set. As a result, it becomes possible to realize the high power factor even in the power source with no power factor-improving circuit. On the other hand, in the case where it can be detected that there is no improvement in power factor when the inlet current I2 is smaller than the predetermined current I4, in order to minimize the temperature ripple as seen in the heater 100, it is possible to give high priority to shortening of the control period of the electric power control.

As described above, according to this embodiment, the power force can be improved while realizing downsizing of the image forming apparatus and a cost reduction.

Embodiment 3

In Embodiments 1 and 2, the supply starting timing of the power source current I3 and the supply ending timing of the power source current I3 are prepared in advance. In Embodiment 3, a constitution applicable to even the case where the supply starting timing of the power source current I3 and the supply ending timing of the power source current I3 change depending on variations or the like in capacity of the commercial power source voltage 501 and the primary smoothing capacitor 86 will be described. That is, a method in which the supply starting timing of the power source current I3 and the supply ending timing of the power source current I3 can be detected without providing a dedicated detecting circuit even in the case where the supply starting timing of the power source current I3 and the supply ending timing of the power source current I3 change will be described. Also in this embodiment, a difference from Embodiments 1 and 2 will be principally described, and common constitutions will be omitted from description by adding the same reference numerals or symbols. In this embodiment, a method in which the supply starting timing of the power source current I3 and the supply ending timing of the power source current I3 are detected using the inlet current detecting circuit 181 and the heater driving circuit shown in (a) of FIG. 8 which have already existed will be described. The electric power control process for improving the power factor is similar to those in Embodiments 1 and 2, and will be omitted from description.

[Relationship Among Heater Current, Inlet Current and Supplied Electric Power to Heater]

Figure 11:
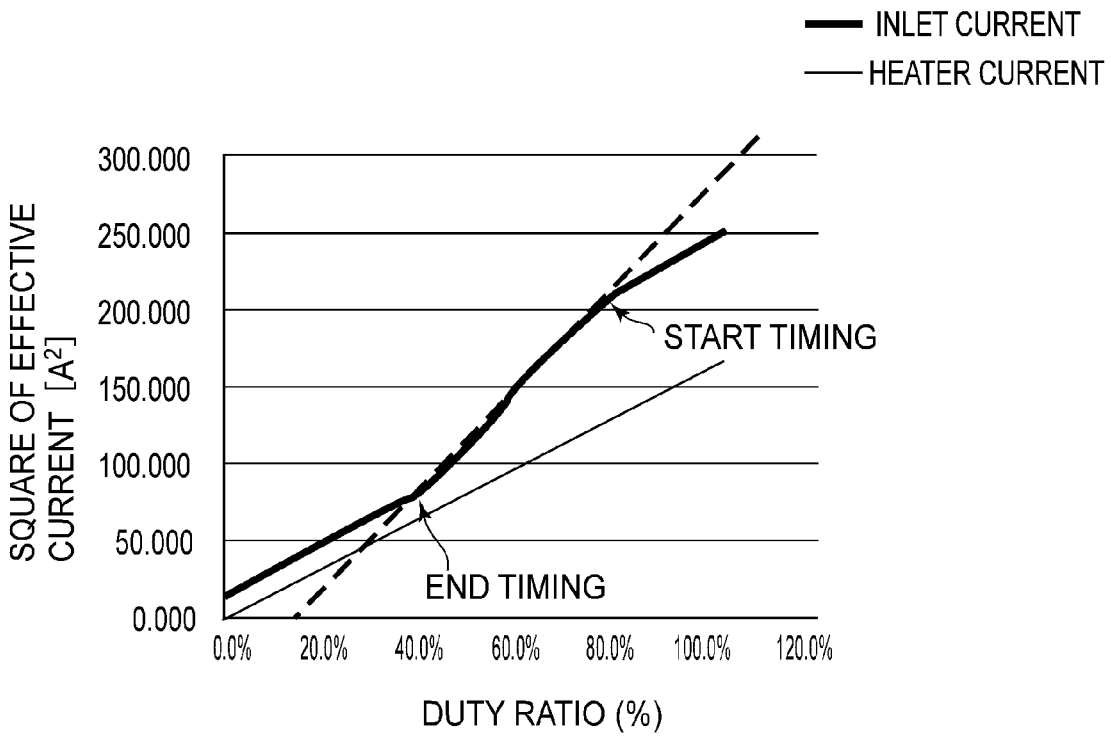
FIG. 11 is a graph showing a relationship between a supplied electric power to a heater and a square value of an effective current in Embodiment 3.

FIG. 11 is a graph showing a relationship between the duty ratio of the electric power supplied to the heater and each of the squared value (thick solid line) of an effective value of the inlet current I2 and a squared value (thin solid line) of an effective value of the heater current I1. In FIG. 11, the abscissa represents the duty ratio of the electric power supplied to the heater in one half wave. It is understood that the squared value of the heat current I1 is increased with a certain slope when the duty ratio is increased. This can be similarly said from also the following formula 1:

$$I1^2 = \frac{P}{R} \quad \text{(formula 1)}$$

In the above formula, P represents the supplied electric power, and R represents a resistance value of the heater 100.

On the other hand, the squared value of the inlet current I2 is different in slope for every region of the duty ratio when the duty ratio of the electric power supplied to the heater is increased. In the neighborhood of the duty ratio of 0% to 40% and the duty ratio of 75% to 100%, the slope is the same as the slope of the squared value of the heater current I1. However, in a range from 40% to 75% in duty ratio, it is understood that the slope (broken line) of the inlet current I2 is abrupt compared with other ranges. Further, the region where the duty ratio is 40% to 75% is an overlapping region with the power source current I3. That is, at a point (duty ratio of 40% in FIG. 12) where the slope of the inlet current I2 changes in an increasing direction, the timing is the supply ending timing of the power source current I3. Further, at a point (duty ratio of 75% in FIG. 12) where the slope of the inlet current I2 changes in a decreasing direction, the timing is the supply starting timing of the power source current I3. The duty ratio of 0% corresponds to the phase of 180°, and the duty ratio of 100% corresponds to the phase of 0°.

Figure 12:
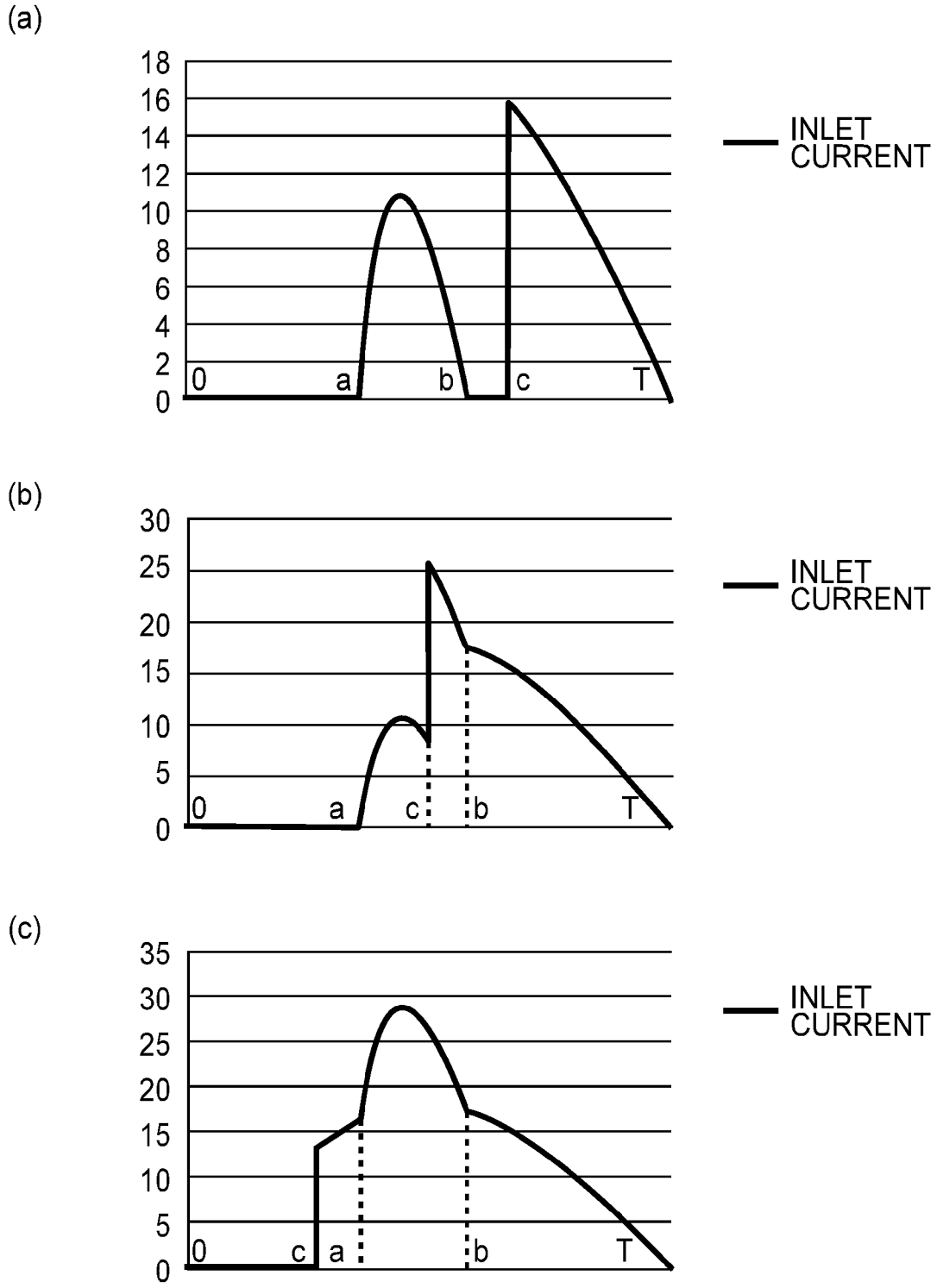
In FIG. 12, (*a*) to (*c*) are graphs each showing an inlet current in Embodiment 3.

Next, with reference to FIG. 12 and formulas 2 to 6-2, a phenomenon such that the slope of the squared value of the inlet current I2 becomes abrupt only in the overlapping region with the power source current I3 in FIG. 11 will be described. In FIG. 12, (*a*) to (*c*) are graphs each showing the inlet current I2, in which the abscissa represents the time, and the ordinate represents a current value. The inlet current I2 is represented by formula 2 below, and a squared value thereof is represented by formula 3 below. In the formulas 2 and 3, i2(t) represents an instantaneous value of the current passing through the inlet 51.

$$I2 = \sqrt{\frac{1}{T}\int_0^T i2(t)^2\,dt} \quad \text{(formula 2)}$$

$$I2^2 = \frac{1}{T}\int_0^T i2(t)^2\,dt \quad \text{(formula 3)}$$

(Case of (a) in FIG. 12)

Calculation of the inlet current I2 in the case where the supply starting timing of the electric power supplied to the heater 100 is later than the supply ending timing of the power source current I3 will be described using the formulas 2 and 3. In FIG. 12, (*a*) is the graph showing the inlet current I2 in the case where the supply starting timing of the electric power supplied to the heater 100 is later than the supply ending timing of the power source current I3. In (a) of FIG. 12, a is the supply starting timing of the power source current I3, b is the supply ending timing of the power source current I3, and c is the supply starting timing of the electric power supplied to the heater 100. Further, T represents timing corresponding to the phase of 180°. At this time, the inlet current I2 in this case can be represented by formula 4 below. In the formula 4, i1(t) is in instantaneous value of the current passing through the heater, and i3(t) is an instantaneous value of the power source current I3.

$$I2^2 = \frac{1}{T}\int_a^b i3(t)^2 dt + \frac{1}{T}\int_c^T i1(t)^2 dt \quad \text{(formula 4)}$$

When the supply starting timing c of the electric power supplied to the heater is changed in a section from b to T, it is understood that the squared value of the inlet current I2 is changed correspondingly to a change in squared value of the heater current I1 in the second term of the formula 4. In (a) of FIG. 12, the section from b to T corresponds to a section from 0% to 40% in duty ratio in FIG. 11. That is, in the case of (a) of FIG. 12, as also shown in FIG. 11, the slope of the inlet current I2 and the slope of the heater current I1 are equal to each other.

(Case of (b) in FIG. 12)

Calculation of the inlet current I2 in the case where the supply starting timing of the electric power supplied to the heater 100 is later than the supply starting timing of the power source current I3 and earlier than the supply ending timing of the power source current I3 will be described with reference to (b) of FIG. 12. In (b) of FIG. 12, a is the supply starting timing of the power source current I3, b is the supply ending timing of the power source current I3, and c is the supply starting timing of the electric power supplied to the heater 100. The inlet current I2 in this case can be represented by formula 5 below.

$$I2^2 = \frac{1}{T}\int_a^c i3(t)^2 dt + \frac{1}{T}\int_c^b \{i3(t) + i1(t)\}^2 dt + \frac{1}{T}\int_b^T i1(t)^2 dt \quad \text{(formula 5)}$$

$$I2^2 = \frac{1}{T}\int_a^c i3(t)^2 dt + \frac{1}{T}\int_c^b i3(t)^2 dt + \frac{1}{T}\int_c^b i1(t)^2 dt + \frac{2}{T}\int_c^b \{i3(t)\times i1(t)\} dt + \frac{1}{T}\int_b^T i1(t)^2 dt \quad \text{(formula 5-1)}$$

$$I2^2 = \frac{1}{T}\int_a^b i3(t)^2 dt + \frac{1}{T}\int_C^T i1(t)^2 dt + \frac{2}{T}\int_c^b \{i3(t)\times i1(t)\} dt \quad \text{(formula 5-2)}$$

In the formula 5, a square of values of the section from a to c (the first term) is a square of only the instantaneous value i3(t) of the power source current I3. A section of c to b (the second term) is a resultant current section of the instantaneous value i3(t) of the power source current I3 and an instantaneous value i1(t) of the heater current I1. Further, in the formula 5, a section of b to T (the third term) is a section of only the instantaneous value i1(t) of the heater current I1. When the formula 5 is developed, the formula 5-1 is obtained. When the formula 5-1 is summarized, the squared value of the inlet current I2 can be expressed by the formula 5-2. In the formula 5-2, the first term represents the squared value of the power source current I3 in a section of a to b, and the second term represents the squared value of the heater current I1 in a section of c to T. In the formula 5-2, the third term represents the term generated by synthesizing the instantaneous value i3(t) of the power source current I3 and the instantaneous value i1(t) of the heater current I1 and then by squaring the resultant value. When the supply starting timing c of the electric power supplied to the heater is changed in a section from a to b, it is understood that the squared value of the inlet current I2 is changed correspondingly to a change the third term in addition to the change in the squared value of the heater current I1 in the second term of the formula 5-2. In (b) of FIG. 12, the section from a to b corresponds to a section from 40% to 75% in duty ratio in FIG. 11. That is, in the case of (b) of FIG. 12, as also shown in FIG. 11, the slope of the inlet current I2 is more abrupt than the slope of the heater current I1.

(Case of (c) in FIG. 12)

Calculation of the inlet current I2 in the case where the supply starting timing of the electric power supplied to the heater 100 is earlier than the supply ending timing of the power source current I3 will be described with reference to (c) of FIG. 12. In (c) of FIG. 12, a is the supply starting timing of the power source current I3, b is the supply ending timing of the power source current I3, and c is the supply starting timing of the electric power supplied to the heater 100. The inlet current I2 in this case can be represented by formula 6 below.

$$I2^2 = \frac{1}{T}\int_c^a i1(t)^2 dt + \frac{1}{T}\int_a^b \{i3(t) + i1(t)\}^2 dt + \frac{1}{T}\int_b^T i1(t)^2 dt \quad \text{(formula 6)}$$

$$I2^2 = \frac{1}{T}\int_c^a i1(t)^2 dt + \frac{1}{T}\int_a^b i3(t)^2 dt + \frac{1}{T}\int_a^b i1(t)^2 dt + \frac{2}{T}\int_a^b \{i3(t)\times i1(t)\} dt + \frac{1}{T}\int_b^T i1(t)^2 dt \quad \text{(formula 6-1)}$$

$$I2^2 = \frac{1}{T}\int_c^T i1(t)^2 dt + \frac{1}{T}\int_a^b i3(t)^2 dt + \frac{2}{T}\int_a^b \{i3(t)\times i1(t)\} dt \quad \text{(formula 6-2)}$$

In the formula 6, a square of values of the section from c to a (the first term) is a square of only the instantaneous value i1(t) of the heater current I1. A section of a to be (the second term) is a resultant current section of the instantaneous value i3(t) of the power source current I3 and an instantaneous value i1(t) of the heater current I1. Further, in the formula 6, a section of b to T (the third term) is a section of only the instantaneous value i1(t) of the heater current I1. When the formula 6 is developed, the formula 6-1 is obtained. When the formula 6-1 is summarized, the squared value of the inlet current I2 can be expressed by the formula 6-2. In the formula 6-2, the first term represents the squared value of the heater current I1 in a section of c to T, and the second term represents the squared value of the power source current I3 in a section of a to b. In the formula 6-2, the third term represents the term generated by synthesizing the instantaneous value i3(t) of the power source current I3 and the instantaneous value i1(t) of the heater current I1 and then by squaring the resultant value. When the supply starting timing c of the electric power supplied to the heater is changed in a section from 0 to a, it is understood that the squared value of the inlet current I2 is changed correspondingly to a change in the squared value of the heater current I1 in the first term of the formula 6-2. In (c) of FIG. 12, the section from 0 to a corresponds to a section from 75% to 100% in fixing duty ratio in FIG. 11. That is, in the case of (c) of FIG. 12, as also shown in FIG. 11, the slope of the inlet current I2 and the slope of the heater current I1 are equal to each other.

Based on a principle described above, the slope of the squared value of the inlet current I2 is abrupt only in a region where the heater current overlaps with the power source current I3, and by using this principle, it is possible to detect the supply starting timing of the power source current I3 and the supply ending timing of the power source current I3. In this embodiment, the supply starting timing of the power source current I3 and the supply ending timing of the power source current I3 are calculated from the slope of the squared value of the inlet current I2. However, as the method of detecting the supply starting timing of the power source current I3 and the supply ending timing of the power source current I3, in order to simplify the calculation or the like, a method is provided in which the timing is calculated from a waveform obtained by subtracting the squared value of the heater current I1 from the squared value of the inlet current I2. Further, as the method of detecting the supply starting timing of the power source current I3 and the supply ending timing of the power source current I3, there is also a method in which the timing is calculated from a slope of a value obtained by subtracting the heater current I1 from the inlet current value I2. Thus, these methods are not limited to those in this embodiment.

[Detecting Process of Supply Starting Timing and Supply Ending Timing of Power Source Current]

Figure 13:
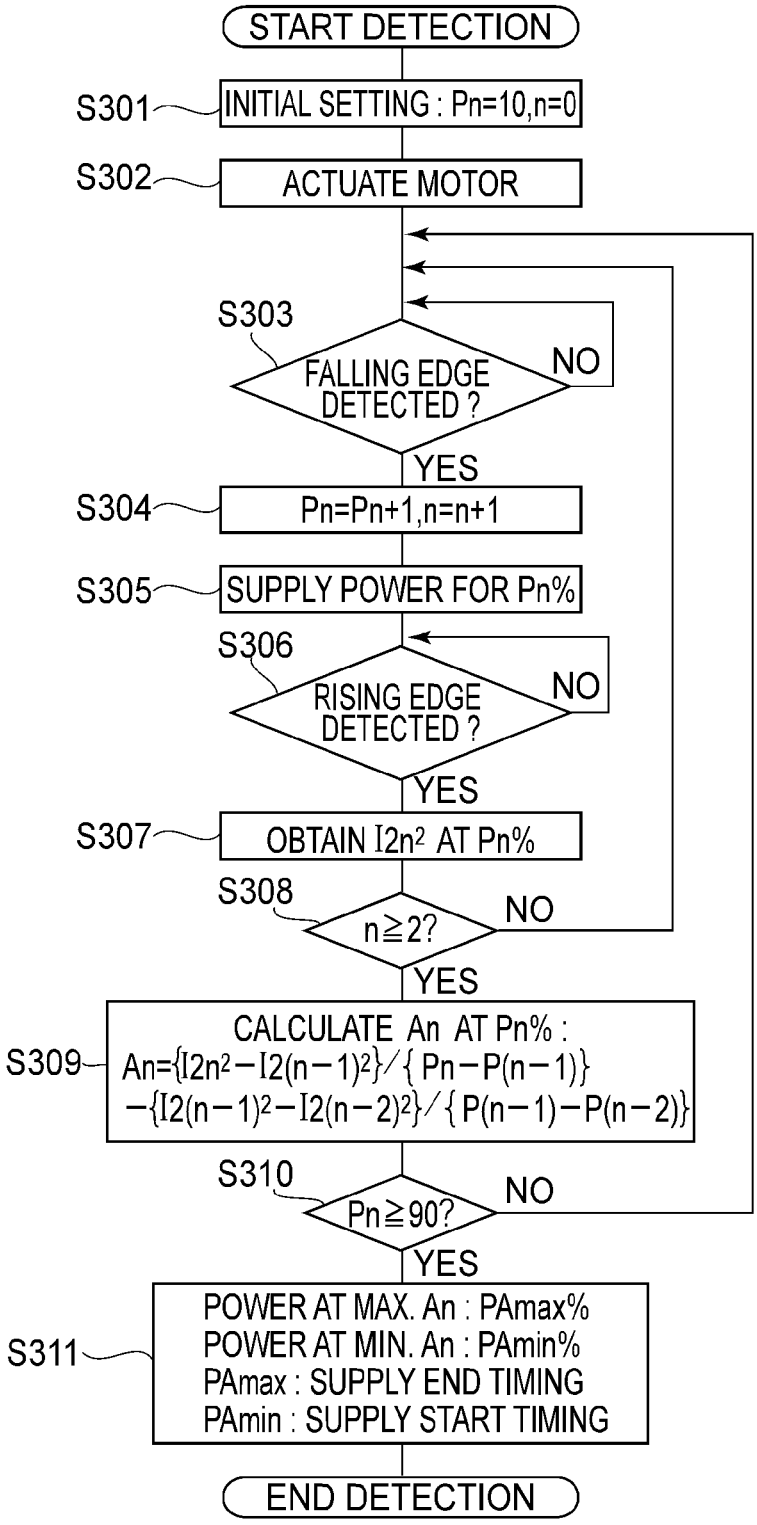
FIG. 13 is a flowchart showing a detecting process of timing in Embodiment 3.

A detecting process of the supply starting timing and the supply ending timing of the power source current I3 passing through the power source unit 53 by using the inlet current detecting circuit 181 in this embodiment will be described in the flowchart of FIG. 13 executed by the CPU 32. In S301, the CPU 32 makes the initial setting of respective variables. In this embodiment, the electric power supplied to the heater 100 in an n-th half wave is Pn, and Pn=10 and n (counter)=0 are set. In S302, the CPU 32 actuates a motor or the like which operates during the image formation. In S302, the CPU 32 discriminates whether or not the falling edge of the zero-cross signal 502 outputted from the zero-cross generating circuit 57 is detected. In the case where the CPU 32 discriminates that the falling edge of the zero-cross signal 502 is not detected, the CPU 32 repeats the process of S303. In S303, in the case where the CPU 32 discriminates that the falling edge of the zero-cross signal 501 is detected, in S304, the CPU 32 increments the supplied electric power Pn and the counter n by 1 in S304 (Pn=Pn+1, n=n+1).

In S305, the CPU 32 supplies the electric power of Pn % to the heater 100.

In S306, the CPU 32 discriminates whether or not the rising edge of the zero-cross signal 502 outputted from the zero-cross generating circuit 57, and in the case where the CPU 32 discriminates that the rising edge of the zero-cross signal 502 is not detected, the CPU 32 repeats the process of S306. In S306, in the case where the CPU 32 discriminates that the rising edge of the zero-cross signal 502 is detected, the sequence goes to a process in S307. In S307, the CPU 32 detects the inlet current, when the electric power of Pn % is supplied in S305, by the inlet current detecting circuit 181, and then obtains a squared value of the inlet current. Hereinafter, the inlet current when the electric power of Pn % is supplied will be described as I2n. The square value thereof is $I2n^2$.

In S308, the CPU 32 discriminates whether or not the counter n is 2 or more, and in the case where the CPU 32 discriminates that the counter n is not 2 or more, the sequence returns to the process of S303. In S308, in the case where the CPU 32 discriminates that the counter n is 2 or more, the sequence goes to a process of S309. In S309, the CPU 32 applies a change amount An of the slope of the squared value of the inlet current I2n to the supplied electric power Pn %.

$$An = \{I2n^2 - I2(n-1)^2\}/\{Pn - P(n-1)\} - \{I2(n-1)^2 - I2(n-2)^2\}/\{P(n-1) - P(n-2)\}$$

The calculated value of An is stored in, e.g., RAM 32*b*.

In S310, the CPU 32 discriminates whether or not the supplied electric power Pn % is 90 or more, and in the case where the CPU 32 discriminates that the supplied electric power Pn % is not 90 or more, the sequence returns to the process of S303. That is, the CPU 32 calculates the inlet current I2n at the supplied electric power Pn % and the change amount An of the slope of the squared value of the inlet current I2n to each of values of the supplied electric power Pn % in the processes S303 to S309 until the supplied electric power Pn % reaches 90 or more. In S310, in the case where the CPU 32 discriminates that the supplied electric power Pn % is 90 or more, the sequence goes to a process of S311.

In S311, the CPU 32 reads out the value of An stored in the RAM 32*b*, and obtains a duty ratio PA max when the change amount An of the slope of the squared value of the inlet current I2n to the supplied electric power Pn % is a maximum, and a duty ratio PA mm when the change amount An is a minimum. The duty ratios PAmax and PAmin are not limited to those obtained in this embodiment, but may also be those obtained by other known extracting methods of maximum and minimum values. As described with reference to FIG. 11, the point where the slope changes from a moderate slope to an abrupt slope is the supply ending timing of the power source current I3, and the point where the slope changed from the abrupt slope to the moderate slope is the supply starting timing of the power source current I3. At the point changed in slope from the moderate slope to the abrupt slope, a slope change amount A is a maximum. At the point changed in slope from the abrupt slope to the moderate slope, the slope change amount A is a minimum. Accordingly, PAmax obtained in S311 is the supply ending timing of the power source current I3, and PAmin is the supply starting timing of the power source current I3. The values of PAmax and PAmin calculated by the CPU 32 in S311 are stored in, e.g., the RAM 32*b*.

Figure 10:
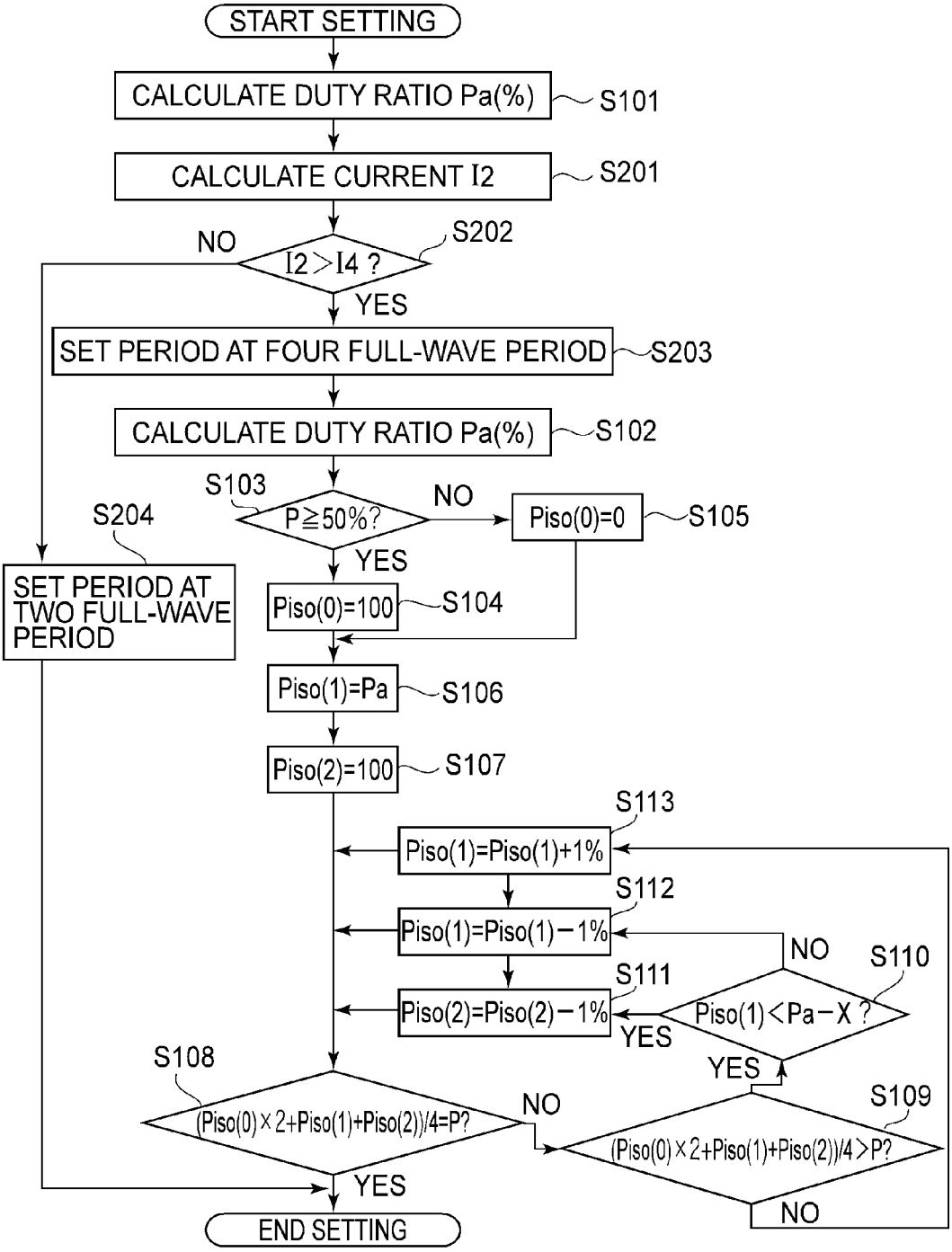
FIG. 10 is a flowchart showing a process of setting a supplied electric power pattern in Embodiment 2.

In the case where the detecting process in this embodiment is applied to Embodiments 1 and 2, e.g., detecting process in this embodiment is carried out during the process of S102 in FIG. 7 or 10. The detecting process in this embodiment may also be carried out before the process of S102 in FIG. 7 or 10.

As described above, by the detecting process in this embodiment, it is possible to detect the supply starting timing of the power source current I3 and the supply ending timing of the power source current I3. In this embodiment, the duty ratio is gradually changed from 10% to 90% in an increment of 1% (S304 and S310 in FIG. 13), so that the supply starting timing and the supply ending timing of the power source current I are obtained. However, when the duty ratio is changed, in an initial stage, the duty ratio is changed in a large increment, so that the supply starting timing and the supply ending timing of the power source current I may also be roughly calculated. In this case, in the neighborhood of each calculated timing, the duty ratio is changed in a small increment, so that the supply starting timing and the supply ending timing of the power source current I3 are detected. Further, the detecting process in this embodiment may also be carried out only in the neighborhood of each of the supply starting timing and the supply ending timing of the power source current I3. In this case, the time required for the timing detecting process can be shortened. In this way, the detecting method of the supply starting timing and the supply ending timing of the power source current I3, and the number and the order of measurements of the inlet current I2n are not limited to those in this embodiment.

As described above, according to this embodiment, it is possible to improve the power factor while realizing the downsizing of the image forming apparatus and a cost reduction.

Embodiment 4

In Embodiment 3, the example in which the duty ratio of the electric power supplied to the heater is changed from 10% to 90% in the increment of 1% to calculate the supply starting timing of the power source current I3 and the supply ending timing of the power source current I3 was described. In Embodiment 4, a constitution is employed in which whether or not the supply starting timing of the power source current I3 and the supply ending timing of the power source current I3 fluctuate depending on a variation in load or the commercial power source voltage 501 is checked. Further, an example in which the supply starting timing and the supply ending timing of the power source current I3 are detected again and then whether or not there is a need to make the change is discriminated will be described. Constitutions similar to those described in Embodiments 1 to 3 will be omitted from description by adding the same reference numerals or symbols.

Figure 14:
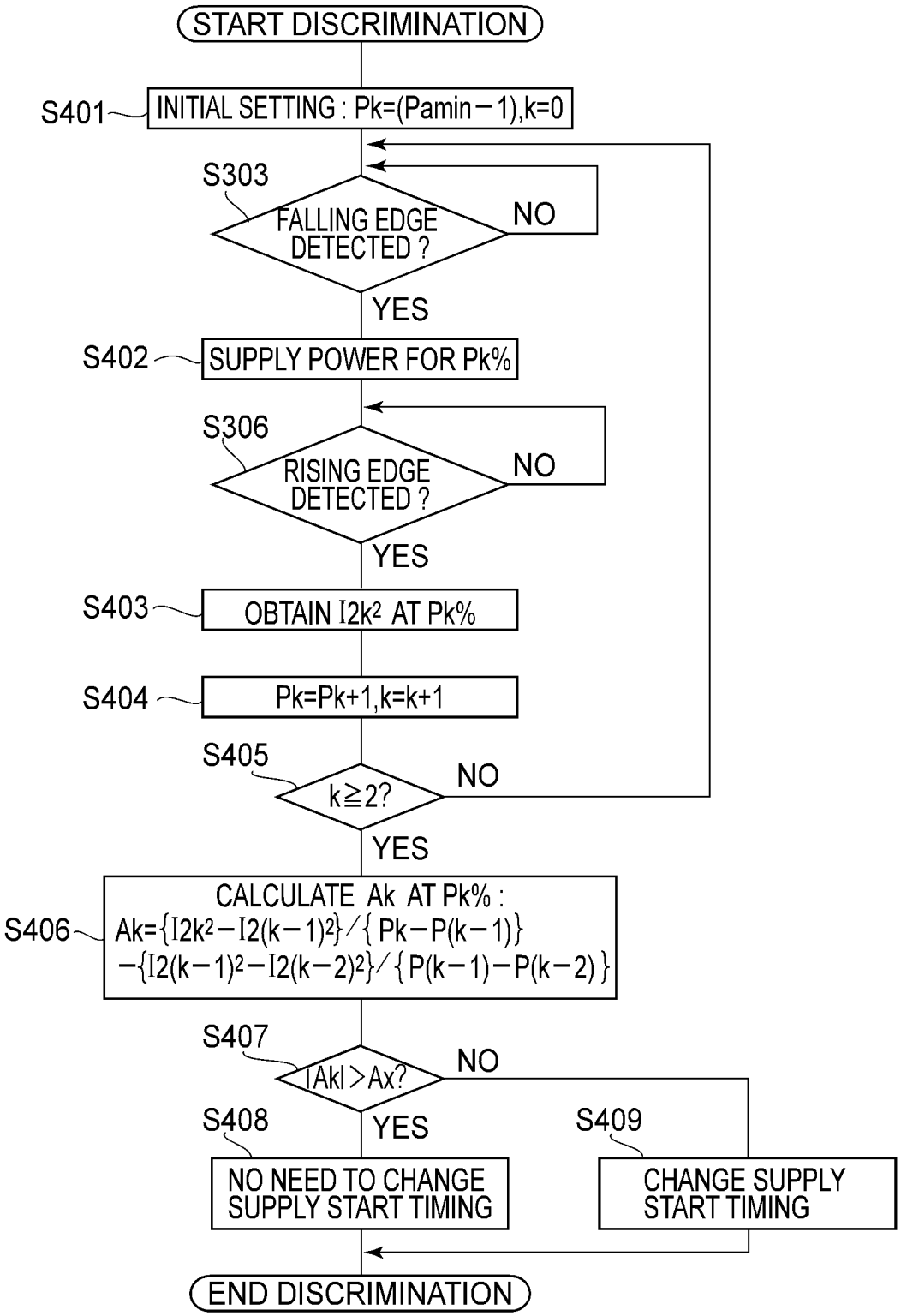
FIGS. 14 and 15 are flowcharts each showing a discriminating process as to whether or not a change in timing is needed in Embodiment 4.

FIG. 14 is a flowchart for illustrating a control process of a discriminating sequence, by the CPU 32, as to whether or not supply starting timing of the power source current I3 should be changed in this embodiment. In FIG. 14, the steps as those in FIG. 13 will be omitted from description by adding the same step symbols. Further, the inlet current in this embodiment will be described by adding a symbol of I1k (and $I2k^2$ as a squared value) in order to discriminate the inlet current I1k from the inlet current I2n in Embodiment 3.

In S401, the CPU 32 makes the initial setting of respective variables. That is, the CPU 32 sets supplied electric power Pk at PAmin−1 (Pk=PAmin−1), and sets a counter k at 0 (k=0). That is, as the supplied electric power Pk, a value which is smaller than the supply starting timing PAmin of the power source current I3 by 1% is set. The process of S303 is the same as that described in Embodiment 3, and therefore will be omitted from description. In S402, the CPU 32 supplies the electric power Pk %. The process of S306 is the same as that described in Embodiment 3, and therefore will be omitted from description.

In S403, the CPU 32 detects the inlet current, when the electric power of Pk % is supplied in S402, by the inlet current I2k detecting circuit 181, and then obtains a squared value of the inlet current I2k. In S404, the CPU 32 increments the supplied electric power Pk % and the counter k by 1 (Pk=Pk+1, k=k+1). In S405, the CPU 32 discriminates whether or not the counter k is 2 or more, and in the case where the CPU 32 discriminates that the counter k is not 2 or more, the sequence returns to the process of S303.

In S405, in the case where the CPU 32 discriminates that the counter n is 2 or more, in S406, the CPU 32 applies a change amount Ak of the slope of the squared value of the inlet current I2k to the supplied electric power Pk %.

$$An = \{I2k^2 - I2(k-1)^2\}/\{Pk - P(k-1)\} - \{I2(k-1)^2 - I2(k-2)^2\}/\{P(k-1) - P(k-2)\}$$

In S407, the CPU 32 discriminates whether or not an absolute value |Ak| of the slope change amount Ak is larger than a predetermined slope change amount Ax. The predetermined slope change amount Ax is a threshold for discriminating whether or not the slope change amount Ak changes. In S407, in the case where the CPU 32 discriminates that the absolute value |Ak| of the slope change amount Ak is larger than the predetermined slope change amount Ax, the CPU 32 discriminates that the slope change amount Ak of the squared value of the inlet current I2k, and then the sequence goes to a process of S408. In S401, the CPU 32 sets, as the supplied electric power Pk %, a value which is 1% smaller than the supplied electric power PAmin corresponding to that at the supply starting timing of the power source current I3. For this reason, in S406, the CPU 32 calculates the slope change amount in the neighborhood of the supplied electric power PAmin %, and when the slope of the squared value of the inlet current I2k changes, |Ak| is larger than the predetermined slope change amount Ax. In S408, the CPU 32 discriminates that there is no need to make the change since the supply starting timing of the power source current I3 is not fluctuating.

On the other hand, in S407, in the case where the CPU 32 discriminates that the absolute value |Ak| of the slope change amount Ak is not larger than the predetermined slope change amount Ax, i.e., in the case where the slope of the squared value of the inlet current I1k does not change, the sequence goes to a process of S409. In S409, the CPU 32 detects that the change is needed since the supply starting timing of the power source current I3 fluctuates. In S409, in the case where the CPU 32 discriminates that the change in supply starting timing of the power source current I3 is needed, the CPU 32 carries out the detecting process of the supply starting timing of the power source current I3 described in Embodiment 3.

[Discriminating Process Whether or not Change is Needed (End Timing)]

Figure 15:
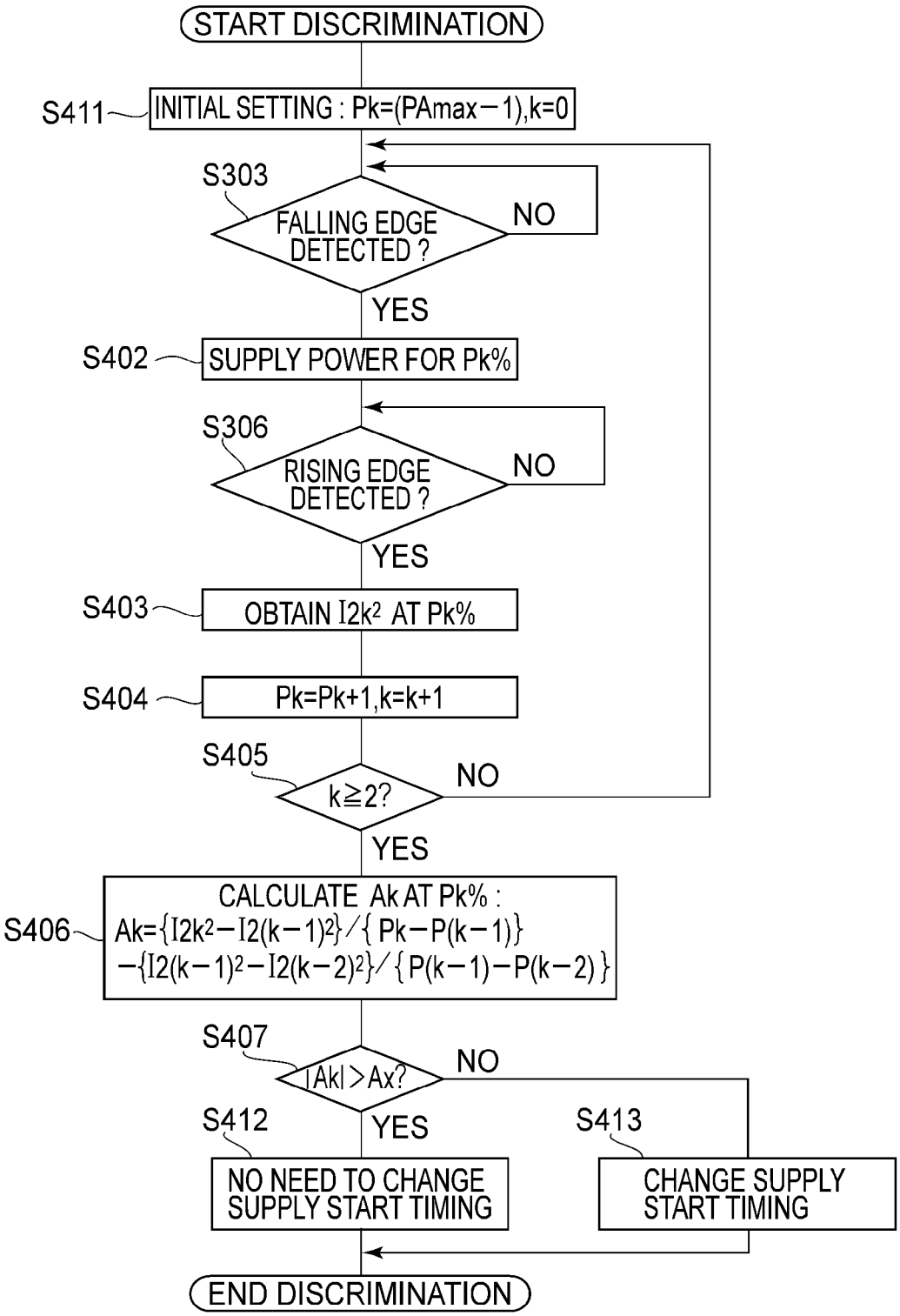

A discriminating process as to whether or not the supply ending timing of the power source current I3 should be changed in this embodiment will be described with reference to FIG. 15. In FIG. 15, the steps in which the same processes as those in the flow chart described with reference to FIG. 14 will be omitted from description by adding the same step symbols. In S411, the CPU 32 makes the initial setting of respective variables. That is, the CPU 32 sets supplied electric power Pk at PAmax−1 (Pk=PAmax −1), and sets a counter k at 0 (k=0). That is, as the supplied electric power Pk, a value which is smaller than the supply ending timing PAmax of the power source current I3 by 1% is set. The processes of S303 to S406 are the same as those described with reference to FIG. 14, and therefore will be omitted from description.

In S407, in the case where the CPU 32 discriminates that the absolute value |Ak| of the slope change amount Ak, calculated in S406, of the squared value of the inlet current I2 is larger than the predetermined slope change amount Ax, the sequence goes to a process of S412. In S412, the CPU 32 discriminates that there is no need to make the change since the supply ending timing of the power source current I3 is not fluctuating. On the other hand, in S407, in the case where the CPU 32 discriminates that the absolute value |Ak| of the slope change amount Ak of the squared value of the inlet current I2k is the predetermined slope change amount Ax or less, the sequence goes to a process of S413. In S413, the CPU 32 detects that the change is needed since the supply ending timing of the power source current I3 fluctuates. In S413, in the case where the CPU 32 discriminates that the change in the supply ending timing of the power source current I3 is needed, the CPU 32 carries out the detecting process of the supply ending timing of the power source current I3 described in Embodiment 3.

In this way, the CPU 32 carries out the detecting process in Embodiment 4 only in the case where the CPU 32 discriminates that the supply starting timing or the supply ending timing of the power source current I3 fluctuates. Then, the CPU 32 updates information of the supply starting timing or the supply ending timing of the power source current I3 stored in the RAM 32*b*. Then CPU 32 carries out the electric power control process for improving the power factors in Embodiments 1 and 2 by using PAmax or PAmin which is not updated (not fluctuated) or is updated (is fluctuated).

As described above with reference to FIGS. 14 and 15, even in the case where the supply starting timing and the supply ending timing of the power source current I3 change depending on fluctuations in power source voltage and load, it is possible to detect the change in a short time by the process of this embodiment. As described above, according to this embodiment, it is possible to improve the power factor while realizing the downsizing of the image forming apparatus and the cost reduction.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 207243/2013 filed Oct. 2, 2013, which is hereby incorporated by reference.

What is claimed is:

1. An image forming apparatus comprising:

a power source portion configured to convert an AC voltage of a commercial power source into a DC voltage;

a fixing portion configured to heat and fix an image, formed on a recording material, on the recording material, wherein said fixing portion includes a first heat generating element which generates heat by electric power supplied from the commercial power source and a second heat generating element which is controlled independently of the first heat generating element and which generates the heat by the electric power supplied from the commercial power source; and a controller configured to control the electric power supplied to the first and second heat generating elements, wherein when a plurality of periods of an AC waveform of the commercial power source constitute one control period, said controller sets a waveform of a current to be passed through each of the first and second heat generating elements in the one control period so that the total electric power supplied to the first and second heat generating elements in the one control period is dependent on the temperature of said fixing portion, wherein said controller sets the waveform of the current to be passed through each of the first and second heat generating elements so that, in a synchronous half wave in the one control period, when the current passes through one of the first and second heat generating elements from a halfway point of the half wave, the current either passes or does not pass through the other heat generating element throughout a period of the half wave, depending on a duty ratio of the total electric power supplied to said first and second heat generating elements, and wherein said controller sets a current supply starting timing of the current passing through the one of the first and second heat generating elements from the halfway point of the half wave, at a timing when a current passing toward said power source portion stops.

2. An image forming apparatus according to claim 1, further comprising a current detecting portion configured to detect a resultant current passing through said power source portion and the first and second heat generating elements, wherein said controller obtains a timing, when the supply of the current passes toward said power source portion, on the basis of the duty ratio of the electric power supplied to the one of the first and second heat generating elements through which the current passes through from the halfway point of the half wave and a detection result of said current detecting portion.

3. An image forming apparatus according to claim 1, wherein said fixing portion includes a cylindrical fixing film.

4. An image forming apparatus according to claim 3, wherein the first and second heat generating elements are provided on a single heater including a ceramic substrate, and wherein the heater contacts an inner surface of the fixing film.

5. An image forming apparatus comprising:

a fixing portion configured to heat and fix an image, formed on a recording material, on the recording material, wherein said fixing portion includes a first heat generating element which generates heat by electric power supplied from a commercial power source and a second heat generating element which is controlled independently of the first heat generating element and which generates the heat by the electric power supplied from the commercial power source; and a controller configured to control the electric power supplied to the first and second heat generating elements, wherein when a plurality of periods of an AC waveform of the commercial power source constitute one control period, said controller sets a duty ratio of the total electric power for the first and second heat generating elements depending on the temperature of said fixing portion for every one control period, wherein said controller switches a rule of a waveform of an AC current to be passed through each of the first and second heat generating elements depending on the duty ratio of the total electric power, and wherein said controller switches a first rule in which in a synchronous half wave over the one control period, when the current passes through one of the first and second heat generating elements from a halfway point of the half wave, the current either passes or does not pass through the other heat generating element throughout a period of the half wave, depending on the duty ratio of the total electric power, and a second rule in which in the synchronous half wave in at least a part of the one control period, the current is passed through both of the first and second heat generating elements throughout the period of the half wave, and in the synchronous half wave in a remaining part of the one control period, when the current passes through one of the first and second heat generating elements from a halfway point of the half wave, the current either passes or does not pass through the other heat generating element throughout a period of the half wave, depending on the duty ration of the total electric power.

6. An image forming apparatus according to claim 5, further comprising a power source portion configured to convert an AC voltage of a commercial power source into a DC voltage, wherein each of the first and second heat generating elements is supplied with the electric power from the commercial power source without being supplied via said power source portion.

7. An image forming apparatus according to claim 5, wherein the duty ratio of the total electric power in which the second rule is set is larger than the duty ratio of the total electric power in which the first rule is set.

8. An image forming apparatus according to claim 5, wherein the resistance value of the first heat generating element and the resistance value of the second heat generating element are different from each other.

9. An image forming apparatus according to claim 5, wherein said fixing portion includes a cylindrical fixing film.

10. An image forming apparatus according to claim 9, wherein the first and second heat generating elements are provided on a single heater including a ceramic substrate, and wherein the heater contacts an inner surface of the fixing film.

11. An image forming apparatus comprising:

a power source portion configured to convert an AC voltage of a commercial power source into a DC voltage;

a fixing portion configured to heat and fix an image, formed on a recording material, on the recording material, wherein said fixing portion includes a first heat generating element which generates heat by electric power supplied from the commercial power source and a second heat generating element which is controlled independently of the first heat generating element and which generates the heat by the electric power supplied from the commercial power source;

a current detecting portion configured to detect a resultant current passing through said power source portion and the first and second heat generating elements; and a controller configured to control the electric power supplied to the first and second heat generating elements, wherein said controller sets the length of one control period depending on a detected current of said current detecting portion, and wherein when the detected current is larger than a predetermined current, said controller sets the length of the one control period so as to be longer than that when the detected current is smaller than the predetermined current.

12. An image forming apparatus according to claim 11, wherein said fixing portion includes a cylindrical fixing film.

13. An image forming apparatus according to claim 11, wherein the first and second heat generating elements are provided on a single heater including a ceramic substrate, and wherein the heater contacts an inner surface of the fixing film.

* * * * *